US007813685B2

(12) United States Patent
Ishii

(10) Patent No.: US 7,813,685 B2
(45) Date of Patent: Oct. 12, 2010

(54) IMAGE FORMING APPARATUS AND BRUSH MEMBER USED IN THE SAME

(75) Inventor: Hirokazu Ishii, Kanagawa (JP)

(73) Assignee: Ricoh Co., Ltd., Tokyo (JP)

( * ) Notice: Subject to any disclaimer, the term of this patent is extended or adjusted under 35 U.S.C. 154(b) by 1103 days.

(21) Appl. No.: 11/477,667

(22) Filed: Jun. 30, 2006

(65) Prior Publication Data

US 2007/0003333 A1 Jan. 4, 2007

(30) Foreign Application Priority Data

Jun. 30, 2005 (JP) ..... 2005-192831
May 29, 2006 (JP) ..... 2006-148217

(51) Int. Cl.
*G03G 15/20* (2006.01)

(52) U.S. Cl. ..... 399/310; 399/303; 399/313

(58) Field of Classification Search ..... 399/310, 399/316

See application file for complete search history.

(56) References Cited

U.S. PATENT DOCUMENTS

| | | | | |
|---|---|---|---|---|
| 4,513,683 | A * | 4/1985 | Kisler | 118/620 |
| 5,249,022 | A * | 9/1993 | Watanabe et al. | 399/303 |
| 5,515,146 | A | 5/1996 | Harasawa et al. | |
| 5,631,725 | A | 5/1997 | Harasawa et al. | |
| 5,659,842 | A * | 8/1997 | Hasegawa et al. | 399/66 |
| 5,812,919 | A | 9/1998 | Takano et al. | |
| 5,822,667 | A | 10/1998 | Hayama et al. | |
| 5,930,573 | A | 7/1999 | Miyamoto et al. | |
| 6,188,862 | B1 | 2/2001 | Ishii | |
| 6,282,386 | B1 | 8/2001 | Ishii | |
| 6,697,583 | B2 | 2/2004 | Ishii | |
| 6,778,802 | B2 | 8/2004 | Kabata et al. | |
| 6,813,467 | B2 | 11/2004 | Kawahara et al. | |
| 6,895,209 | B2 | 5/2005 | Kawahara et al. | |
| 6,961,535 | B2 | 11/2005 | Kawahara et al. | |
| 2005/0180767 | A1 | 8/2005 | Ishii et al. | |

FOREIGN PATENT DOCUMENTS

| | | |
|---|---|---|
| JP | 9-281768 | 10/1997 |
| JP | 2001-154499 | 6/2001 |
| JP | 2001-154505 | 6/2001 |
| JP | 2001-331047 | 11/2001 |
| JP | 2002-123124 | 4/2002 |
| JP | 2002-169418 | 6/2002 |
| JP | 2002-244455 | 8/2002 |

* cited by examiner

*Primary Examiner*—David M Gray
*Assistant Examiner*—Roy Yi
(74) *Attorney, Agent, or Firm*—Oblon, Spivak, McClelland, Maier & Neustadt, L.L.P.

(57) ABSTRACT

An image forming apparatus includes an image bearing member, an endless moving member configured to receive the image thereon from the image bearing member, and a brush member that includes a fiber portion including a plurality of fibers arranged in a standing condition with respective fiber tips held in contact with an inner surface of the endless moving member. A supporting member is configured to support the fiber portion on a brush surface thereof. The brush member is configured to have a whole brush current value per unit area of the whole brush surface equal to or smaller than 2.5 $\mu A/cm^2$, and one of a maximum sectional current value per unit area of a portion of the whole brush surface equal to or smaller than 22.0 $\mu A/cm^2$ and a ripple of brush sectional current values less than 34%.

23 Claims, 20 Drawing Sheets

* CONDITIONS: 10°C15%RH, RAYON BRUSH, BRUSH VI VALUE: 16.1 μA
( PER UNIT AREA: 1.08 μA )

* CONDITIONS: 32°C80%RH, RAYON BRUSH, BRUSH VI VALUE: 38 μA
( PER UNIT AREA: 2.5 μA )

* CONDITIONS: 10°C15%RH, NYLON BRUSH, BRUSH VI VALUE: 20 μA
( PER UNIT AREA: 1.34 μA )

* CONDITIONS: 32°C80%RH, NYLON BRUSH, BRUSH VI VALUE: 64.2 μA
( PER UNIT AREA: 4.32 μA )

FIG. 36

| MATERIAL | | NYLON6 | | | NYLON12 | |
|---|---|---|---|---|---|---|
| CONDUCTIVE BODY | | CARBON | | | CARBON | |
| STRUCTURE | | UNIFORM DISPERSION TYPE | | | COMPLEX TYPE | |
| CARBON DISPERSION STATE | | THERE ARE DIFFERENT CROSS SECTIONS | | | | |
| LINEAR DENSITY OF FIBER MASS | T/F | 330/48 | 220/96 | 220/192 | 320/48 | 107/48 |
| LINEAR DENSITY OF SINGLE FIBER | T | 6.9 | 2.3 | 1.1 | 6.7 | 2.2 |
| DIAMETER OF SINGLE FIBER | Φ μm | Φ27 | Φ15 | Φ11 | Φ28 | Φ16 |
| SPECIFIC GRAVITY | | 1.26 | | | 1.06 | |
| MELTING POINT | | 220℃ | | | 180℃ | |
| SOFTENING POINT | | 190℃ | | | 150℃ | |
| TENSILE STRENGTH | | 1.1-1.3 | | | 1.2-3.2 | |
| YOUNG'S MODULUS | N/mm | 900-1000 | | | 1500-2100 | |
| MOISTURE CONTENT IN PERCENTAGE | OFFICIAL REGAIN | 4.5% | | | 1.2% | |
| | 20℃65%RH | 3.5-5.0% | | | 1.2% | |
| | 20℃95%RH | 8.0-9.0% | | | 1.5% | |

IMAGE FORMING APPARATUS AND BRUSH MEMBER USED IN THE SAME

CROSS REFERENCE TO RELATED APPLICATIONS

The present application claims priority to Japanese patent applications no. 2005-192831, filed in the Japan Patent Office on Jun. 30, 2005 and no. 2006-148217, filed in the Japan Patent Office on May 29, 2006, the disclosures of which are incorporated by reference herein in their entirety.

BACKGROUND OF THE INVENTION

1. Field of the Invention

The present invention relates to an image forming apparatus and a brush member used in the image forming apparatus. More particularly, the present invention relates to an image forming apparatus (i.e., a copier, facsimile machine, printer and so forth) using a brush member applying a transfer bias with respect to the back side of an endless belt member to transfer an image on the surface of the endless belt member or on a recording medium carried by the endless belt member.

2. Discussion of the Related Art

A conventional background image forming apparatus includes a transfer device having a transfer brush serving as a brush member. The transfer brush includes a conductive brushing fiber portion formed by a plurality of fibers or yarns that are arranged in a standing condition on the surface of a metallic supporting plate, and is usually applied with a predetermined electrical resistance.

FIGS. 1 and 2 show examples of defects in an image caused by the conventional background image forming apparatuses due to the above-described background transfer brush.

A plurality of raised fibers are formed by a conductive material, for example, rayon, nylon or so forth. The transfer brush using the above-described conductive material have easily caused black streaks in a belt moving direction on the halftone area of an output image, as shown in FIG. 1. The black streaks in the belt moving direction are formed along a direction to which a belt member moves or travels, as indicated by arrow E in FIG. 1. The patterns of the black streaks are formed as though the image has been scratched by the plurality of fibers of the transfer brush.

In addition, the inventor of the present invention has found that conventional background image forming apparatuses, using the above-described transfer brush, tend to easily cause sharp changes in image density on the halftone area of an output image. FIG. 2 shows an example of the sharp changes in image density. This is a phenomenon where the density in the halftone image of an output image is rapidly increased after a recording medium, having the output image thereon, has passed a predetermined position in the direction to which the belt member travels, as indicated by arrow E in FIG. 2. The rapid change shown in the enlarged image in FIG. 2 is observed on the area closer to the trailing edge of a recording medium than the area closer to the leading edge thereof. Specifically, when a drum-shaped photoconductive element having a diameter of 100 mm is used as an image bearing member, for example, the rapid changes in image density are observed at a location approximately 314 mm from the leading edge of an A3 size paper.

The inventor of the present invention has found the cause of the above-described black streaks. The cause of the black streaks is described below.

The plurality of raised fibers that form the brushing fiber portion of a transfer brush have deviations in respective electric resistance values. With a relatively small amount of deviations in respective electric resistance values of the plurality of raised fibers, the transfer device applies electric current in a substantially uniform manner from each single fiber thereof to the belt member.

On the other hand, when the transfer brush has a relatively large amount of deviations in respective electric resistance values of the plurality of raised fibers, a greater amount of electric current flows to the belt member from the fibers thereof having a small electric resistance value than the fibers thereof having a large electric resistance value. Under the above-described conditions, the excess electric current is applied from the raised fibers having a small electric resistance value and flows to an image bearing member via the belt member. The flow of the excess electric current can cause a reverse charging on the surface of the image bearing member, resulting in a formation of patterns having streaks. The reversely charged area with streaks on the surface of the image bearing member cannot be sufficiently discharged by a discharging lamp. When the surface of the image bearing member is uniformly charged again after the discharging operation by the discharge lamp, the previously reversely charged area on the image bearing member may have a potential substantially lower than the other areas. Further, a greater amount of development material, such as toner, may adhere on the previously reversely charged area than the other areas. Thereby, the black streaks are shown in the sheet traveling direction.

The inventor of the present invention has also found that the above-described sharp changes in image density can be found at a position to which an image is transferred from an image bearing member. The sharp changes are caused by a timing of when the image bearing member is rotated by one cycle since the start of application of the transfer bias to the transfer brush. The occurrence of the sharp changes in image density is caused by the insufficient discharging of the excess electric current. The excess electric current may be leaked from the transfer brush via the belt member to the image bearing member, but the discharge lamp cannot remove the excess electric current sufficiently. Hence, the potential on the surface of the image bearing member may be lower than usual after the second rotation of the image bearing member.

Further, the inventor of the present invention has found that a transfer brush having the brushing fiber portion with a relatively low electric resistance value tends to easily cause the sharp changes in image density.

SUMMARY OF THE INVENTION

Exemplary aspects of the present invention have been made in view of the above-described circumstances.

Exemplary aspects of the present invention provide a novel image forming apparatus that can reduce or prevent image defects such as black streaks in a belt moving direction and sharp changes in image density.

Other exemplary aspects of the present invention provide a novel brush member used in the above-described novel image forming apparatus.

In one exemplary embodiment, a novel image forming apparatus includes an image bearing member configured to bear an image on a surface thereof, and a transfer device configured to transfer the image formed on the surface of the image bearing member. The transfer device includes an endless moving member configured to receive the image thereon from the image bearing member, and a brush member configured to apply a transfer bias with respect to the endless moving member. The brush member includes a fiber portion including a plurality of fibers arranged in a standing condition with respective fiber tips held in contact with an inner surface of the endless moving member, and a supporting member configured to support the fiber portion on a brush surface thereof. The brush member is configured to have a whole brush current value per unit area of the whole brush surface equal to or smaller than 2.5 $\mu A/cm^2$.

The brush member included in the above-described novel image forming apparatus may be configured to have one of a maximum sectional current value per unit area of a portion of the whole brush surface equal to or smaller than 22.0 $\mu A/cm^2$ and a ripple of brush sectional current values less than 34%.

The plurality of fibers of the brush member may include a polyamide resin material with a conductive electrical resistance controller therein, and the brush member may be configured to have a whole brush current value per unit area of the whole brush surface equal to or smaller than 4.3 μA/cm2.

The brush member included in the above-described novel image forming apparatus may be configured to apply one of a maximum sectional current value per unit area of a portion of the whole brush surface equal to or smaller than 56.5 $\mu A/cm^2$ and a ripple of brush sectional current values less than 34%.

The brush member included in the above-described novel image forming apparatus may be configured to have an electrical resistance per unit length of a single fiber of the plurality of fibers equal to or greater than $3.3\times10^{10}$ Ω/mm.

The brush member included in the above-described novel image forming apparatus may be configured to have a maximum sectional current value per unit area of a portion of the whole brush surface closer to an image bearing member being smaller than a maximum sectional current value per unit area of a portion of the whole brush surface.

The endless moving member included in the image forming apparatus may be configured to have a belt current value per unit area of a transfer nip formed between the endless moving member and the image bearing member, in a range from approximately 1.8 $\mu A/cm^2$ to approximately 3.5 $\mu A/cm^2$.

The above-described novel image forming apparatus may be configured to have an effective transfer charge density equal to or smaller than $6.93\times10^{-8}$ $C/cm^2$.

The transfer device included in the image forming apparatus may be configured to have a transfer charge density of an output current from a transfer biasing source, the transfer charge density being greater than the effective transfer charge density and equal to or smaller than $2.45\times10^{-7}$ $C/cm^2$.

The transfer device included in the above-described novel image forming apparatus may be configured to have a transfer charge density of an output current from a transfer biasing source, the transfer charge density being greater than $5.87\times10^{-8}$ $C/cm^2$ and equal to or smaller than $2.45\times10^{-7}$ $C/cm^2$.

The endless moving member of the transfer device included in the above-described novel image forming apparatus may be configured to have a belt current value per unit area of a transfer nip formed between the endless moving member and the image bearing member, in a range from approximately 0.18 $\mu A/cm^2$ to approximately 3.5 $\mu A/cm^2$.

The transfer device included in the above-described novel image forming apparatus may be configured to have an effective transfer charge density equal to or smaller than $1.06\times10^{-7}$ $C/cm^2$.

The transfer device included in the above-described novel image forming apparatus may be configured to have a transfer charge density of an output current from a transfer biasing source, the transfer charge density being greater than the effective transfer charge density and equal to or smaller than $2.67\times10^{-7}$ $C/cm^2$.

The transfer device included in the above-described novel image forming apparatus may be configured to have a transfer charge density of an output current from a transfer biasing source, the transfer charge density being greater than $5.87\times10^{-8}$ $C/cm^2$ and equal to or smaller than $2.67\times10^{-7}$ $C/cm^2$.

Further, in one exemplary embodiment, a novel brush member includes a fiber portion including a plurality of fibers arranged in a standing condition with an inner surface of the endless moving member, and a supporting member configured to support the fiber portion on a brush surface thereof. The novel brush member is configured to have a whole brush current value per unit area of the whole brush surface equal to or smaller than 2.5 $\mu A/cm^2$.

The novel brush member may be configured to include one of a maximum sectional current value per unit area of a portion of the whole brush surface equal to or smaller than 22.0 $\mu A/cm^2$ and a ripple of brush sectional current values less than 34%.

The plurality of fibers may include a polyamide resin material with a conductive electrical resistance controller therein, and the novel brush member is configured to have a whole brush current value per unit area of the whole brush surface equal to or smaller than 4.3 μA/cm2.

The novel brush member may be configured to apply one of a maximum sectional current value per unit area of a portion of the whole brush surface equal to or smaller than 56.5 $\mu A/cm^2$ and a ripple of brush sectional current values less than 34%.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 36 is a drawing showing the attributes of NYLON6 and NYLON12.

DETAILED DESCRIPTION OF THE PREFERRED EMBODIMENTS

Figure 1:
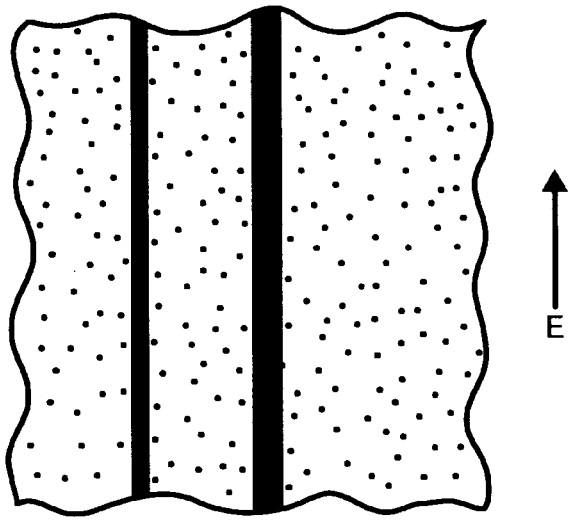
FIG. 1 BACKGROUND ART
FIG. 1 is an example of an image defect caused by a background image forming apparatus.
Figure 2:
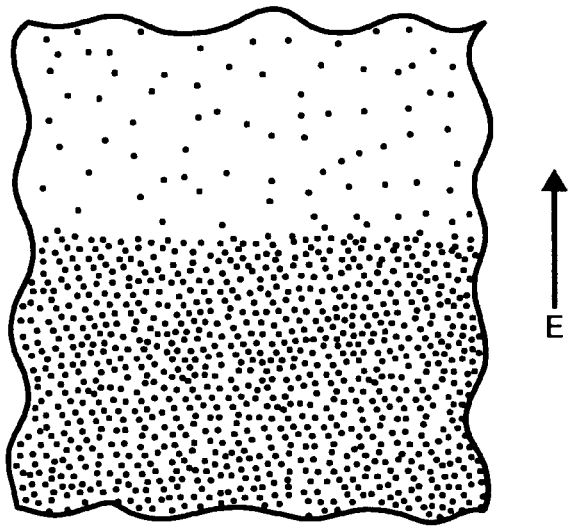
FIG. 2 BACKGROUND ART
FIG. 2 is an example of another image defect caused by a background image forming apparatus.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 3:
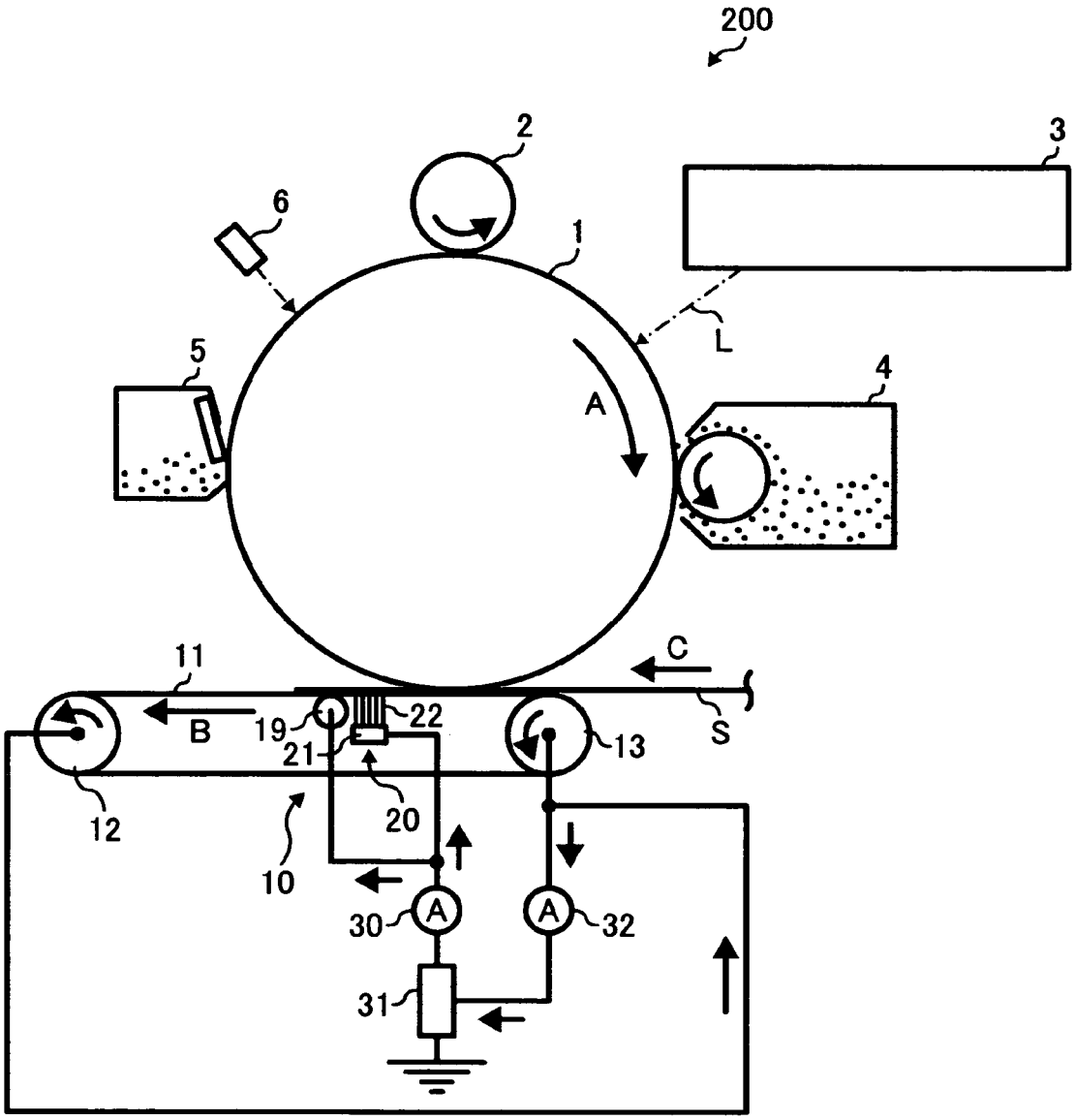
FIG. 3 is a schematic structure of an image forming apparatus according to a first exemplary embodiment of the present invention.

Referring to FIG. 3, a schematic structure of an electrophotographic printer 200 serving as an image forming apparatus according to a first exemplary embodiment of the present invention is described. The electrophotographic printer 200 is hereinafter referred to as a "printer 200".

In FIG. 3, the printer 200 according to the first exemplary embodiment of the present invention includes a drum-shaped photoconductive element or photoconductive drum 1, and various image forming units including a charging roller 2, an optical writing device 3, a developing device 4, a transfer device 10, a drum cleaning device 5, and a discharge lamp 6. The various image forming units are disposed around the photoconductive drum 1.

The photoconductive drum 1 is rotated by a drive unit (not shown) in a clockwise direction as indicated by arrow A in FIG. 3.

The charging roller 2 applied with a charge bias from a biasing source (not shown) uniformly charges the surface of the photoconductive drum 1 to the negative polarity. The charged surface of the photoconductive drum 1 may have, for example, approximately −800V of a surface potential thereon.

The optical writing device 3 serves as an electrostatic latent image forming unit and emits a modulated laser light beam L to the charged surface of the photoconductive drum 1 so that an electrostatic latent image according to a corresponding image signal can be formed on the surface of the photoconductive drum 1. The surface potential of the electrostatic latent image may be, for example, −130V while the surface potential of the other area or the background area may remain to be −800V.

The developing device 4 supplies a development material or toner having respective toner particles, each of which is charged to the negative polarity, onto the electrostatic latent image formed on the surface of the photoconductive drum 1. Thus, the electrostatic latent image is developed into a toner image.

The transfer device 10 receives the toner image from the photoconductive drum 1 so that the toner image can be transferred onto a transfer sheet S serving as a recording medium.

Next, the drum cleaning device 5 removes residual toner remaining on the surface of the photoconductive drum 1 after the toner image has been transferred.

The discharge lamp 6 discharges or removes residual charges from the surface of the photoconductive drum 1.

The transfer device 10 of FIG. 3 includes a sheet conveying belt 11 serving as a loop-shaped endless belt member, a drive roller 12, a driven roller 13, a transfer roller 19, a transfer brush 20, a transfer biasing source 31. The drive roller 12 and the driven roller 13 form a belt mechanism. The transfer roller 19, the transfer brush 20, and the transfer biasing source 31 form a transfer bias applying mechanism. The transfer biasing source 31 is grounded.

The sheet conveying belt 11 conveys a transfer sheet, such as the transfer sheet S, on the outer surface thereof.

The drive roller 12 and the driven roller 13 are surrounded by or spanned around by the sheet conveying belt 11. The drive roller 12 is rotated by a drive unit (not shown) so as to rotate the sheet conveying belt 11 in the counterclockwise direction indicated by arrow B in FIG. 3. The predetermined range of the outer surface of the sheet conveying belt 11, formed between the drive roller 12 and the driven roller 13, is held in contact with the surface of the photoconductive drum 1 so as to form a transfer nip portion.

The transfer roller 19 of the transfer bias applying mechanism includes a metallic material such as a stainless steel, and is disposed to rotate while being held in contact with the inner surface of the sheet conveying belt 11. The contact portion of the transfer roller 19 is located in the predetermined range between the drive roller 12 and the driven roller 13 and downstream of the transfer nip portion in the belt moving direction.

The transfer brush 20 of the transfer bias applying mechanism includes a metallic holder 21 and a brushing fiber portion 22.

The metallic holder 21 serves as a conductive supporting member and includes a metal such as a stainless steel.

The brushing fiber portion 22 includes hair or a plurality of fibers fixedly arranged in a standing condition on a surface of the metallic holder 21 and adhered by a conductive adhesive. The fiber tips of the plurality of raised fibers are held in contact with the inner surface of the sheet conveying belt 11. The contact portion of the fiber tips of the brushing fiber portion 22 is located in the predetermined range between the drive roller 12 and the driven roller 13 and upstream of the transfer roller 19 in the belt moving condition.

The metallic holder 21 of the transfer brush 20 is connected with the transfer biasing source 31 via a first ampere meter 30.

The drive roller 12 supporting the sheet conveying belt 11 also includes a roller shaft formed by a metallic material such as a stainless steel. The roller shaft thereof is connected with a wire via a terminal (not shown).

The driven roller 13 supporting the sheet conveying belt 11 includes a roller shaft formed by a metallic material such as a stainless steel. The roller shaft thereof is connected with a different wire via a terminal (not shown), which is different from the terminal for the drive roller 12.

The wire from the drive roller 12 and the wire from the driven roller 13 are connected with each other. The connected wire further runs via a second ampere meter 32 and is connected with the transfer biasing source 31.

Electrical charge from the transfer biasing source 31 flows toward the sheet conveying belt 11.

A portion of the electrical charge flows from the transfer biasing source 31 via the first ampere meter 30, through the metallic holder 21, and through the brushing fiber portion 22 to the sheet conveying belt 11. This electrical charge travels on the inner surface of the sheet conveying belt 11 in the belt moving direction and reaches the drive roller 12 and the driven roller 13. The electrical charge then flows from the drive roller 12 and the driven roller 13 via the second ampere meter 32 and the transfer biasing source 31 to the ground.

Some of the electrical charge moves across the thickness direction of the sheet conveying belt 11 to the photoconductive drum 1. The current value obtained due to the flow of the electrical charge, which is a transfer current value, becomes substantially equal to a value obtained by subtracting the current value measured by the first ampere meter 30 from the current value measured by the second ampere meter 32.

The transfer biasing source 31 includes a constant current control circuit (not shown) therein. The constant current control circuit controls the output voltage value so that the previously obtained transfer current value can be stabilized to a predetermined target value. The above-described control is hereinafter referred to as a "constant current control." By performing the constant current control, the transfer current value during image forming operations can be maintained to a substantially stable level.

The sheet conveying belt 11 is formed by a belt base layer including a conductive rubber and a surface layer including a conductive resin. The surface layer is overlaid onto the belt base layer, which corresponds to the outer surface of the sheet conveying belt 11. The outer surface thereof is adjusted to have a surface resistivity of $10^8$ Ω/sq. to $10^{13}$ Ω/sq. in the JISK6911 standard, and the inner surface thereof is adjusted to have a surface resistivity of $10^7$ Ω/sq. to $10^{10}$ Ω/sq. in the JISK6911 standard. The volume resistivity of the entire range of the sheet conveying belt 11 is adjusted to be $10^7$ Ω·cm to $10^{11}$ Ω·cm in the JISK6911 standard.

The printer 200 also includes a sheet feeding device (not shown). The sheet feeding device feeds and conveys the transfer sheet S in the direction indicated by arrow C in FIG. 3, toward the transfer nip portion so that the transfer sheet S can receive the toner image on a surface thereof from the photoconductive drum 1 at the transfer nip portion.

Specifically, the transfer sheet S is conveyed to the transfer nip portion while being carried on the outer surface of the sheet conveying belt 11 of the transfer device 10. At the transfer nip portion, the toner image formed on the surface of the photoconductive drum 1 is transferred onto the surface of the transfer sheet S by application of the previously described transfer current and a nip pressure exerted at the transfer nip portion.

Next, the transfer sheet S having the toner image thereon is conveyed to a fixing unit (not shown) in which the toner image is fixed onto the surface of the transfer sheet S, and is then discharged to the outside of the printer 200.

Figure 4:
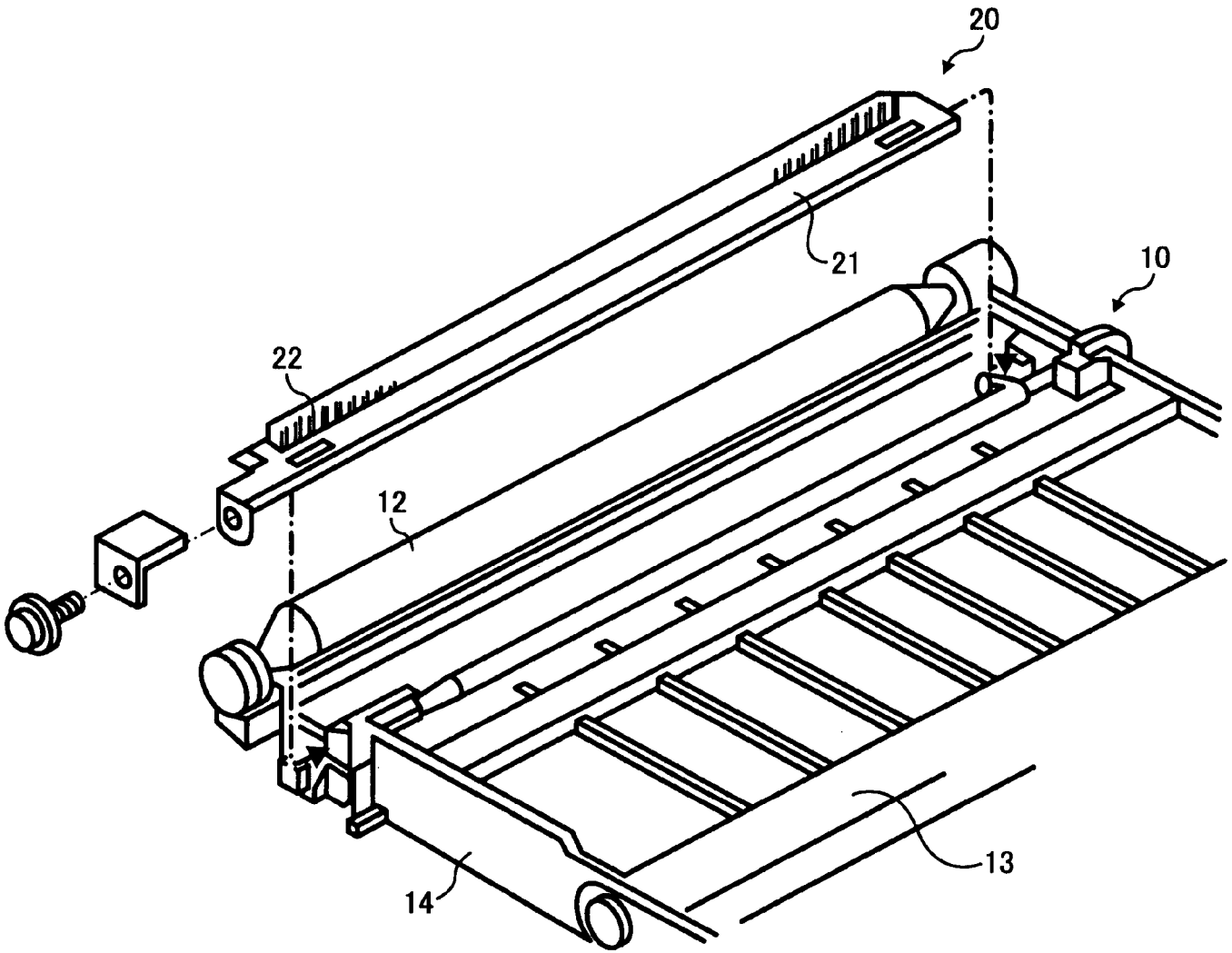
FIG. 4 is a perspective view of the image forming apparatus of FIG. 3, focusing on a transfer device according to the first exemplary embodiment of the present invention.
Figure 5:
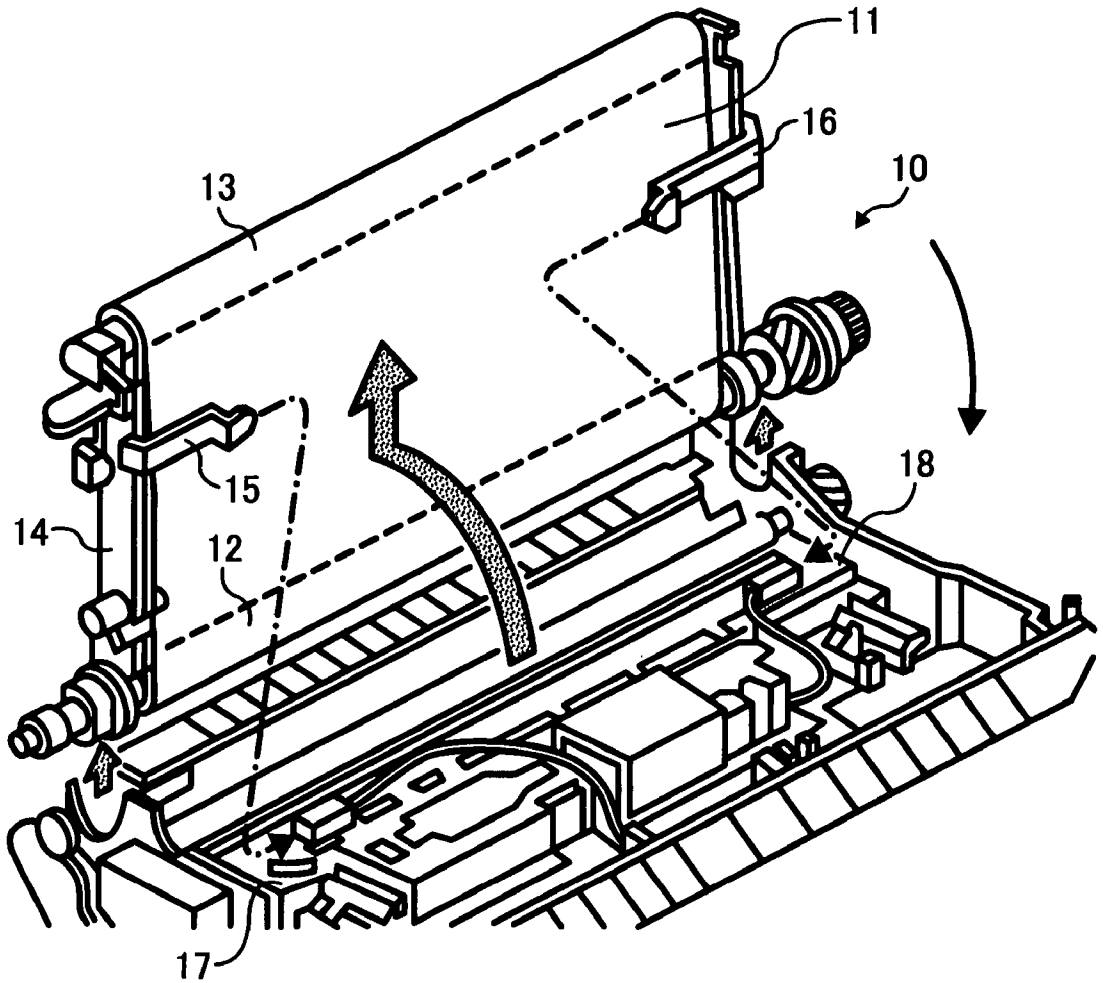
FIG. 5 is a perspective view of the image forming apparatus of FIG. 3, focusing on the transfer device of FIG. 4.

Referring to FIGS. 4 and 5, a schematic structure of the transfer device 10 is described.

In FIG. 4, the transfer device 10 includes a roller supporting member 14. The roller supporting members 14 has two end portions, one of which supports one end portion of the drive roller 12 and the other of which supporting one end portion of the driven roller 13. After the transfer brush 20 is attached to the roller supporting member 14, the roller supporting member 14 is surrounded by the sheet conveying belt 11.

As shown in FIG. 5, the transfer device 10 further includes a first bias terminal 15 and a second bias terminal 16. After the roller supporting member 14 is surrounded by the sheet conveying belt 11, one end portion (not shown) of the first bias terminal 15 is fixed to one end portion of the roller supporting member 14 in the belt width direction thereof and one end portion (not shown) of the second bias terminal 16 is fixed to the other end portion of the roller supporting member 14 in the belt width direction thereof, as shown in FIG. 5. The one end portion of the first bias terminal 15 is disposed inside the loop of the sheet conveying belt 11 and is electrically connected to the metallic holder 21 of the transfer brush 20. The one end portion of the second bias terminal 16 is disposed inside the loop of the sheet conveying belt 11 and is connected to the metallic roller shaft of the driven roller 13.

The other end portions of the first and second bias terminals 15 and 16 form respective free end portions thereof. The free end portions of the first and second bias terminals 15 and 16 are disposed facing each other with a predetermined gap formed therebetween in parallel with the lower tensioned surface of the sheet conveying belt 11.

After the first and second bias terminals 15 and 16 are attached to the roller supporting member 14, the transfer device 10 is attached to the printer 200 as shown in FIG. 5. Next, the first bias terminal 15 is closely attached to a first contact terminal 17, which is mounted on the printer 200, and the second bias terminal 16 is also closely attached to a second contact terminal 18, which is also mounted on the printer 200. The first contact terminal 17 is connected via the first ampere meter 30 (see FIG. 3) to the transfer biasing source 31 (see FIG. 3). The second contact terminal 18 is connected via the transfer biasing source 31 (see FIG. 3) and the second ampere meter 32 (see FIG. 3) to the ground.

The inventor of the present invention performed experiments to complete the printer 200. The experiments are described below.

[Preparation 1 Before Experiments]

Before starting the experiments, the inventor of the present invention prepared a plurality of transfer brushes having various electrical resistance characteristics. The plurality of transfer brushes have similar structures, except that the respective brushing fiber portions include different materials. Therefore, each of the plurality of transfer brushes may be referred to as the transfer brush 20.

The detailed structure of the transfer brush 20 is described with reference to FIGS. 6 and 7.

The brushing fiber portion 22 of the transfer brush 20 is formed by a plurality of raised fibers or hair of the transfer brush 20. In FIG. 6, each of the raised fibers is attached via conductive double-sided tape 23 to the metallic holder 21 formed of stainless steel (SUS304). The conductive double-sided tape 23 is formed by a material having conductivity substantially the same as a metal.

Each of the fibers is arranged in a standing condition and protrudes from the upper surface of the conductive double-sided tape 23. The protruding amount "t1" of the fiber is approximately 5.8 mm. The thickness "t2" of the raised fiber from the fiber tips of the brushing fiber portion 22 to the opposite surface of the metallic holder 21 is approximately 6.8 mm. The brushing fiber portion 22 also has a brush width "W1", which corresponds to a distance of the brushing fiber portion 22 in the belt moving direction, of approximately 5 mm.

Figure 7:
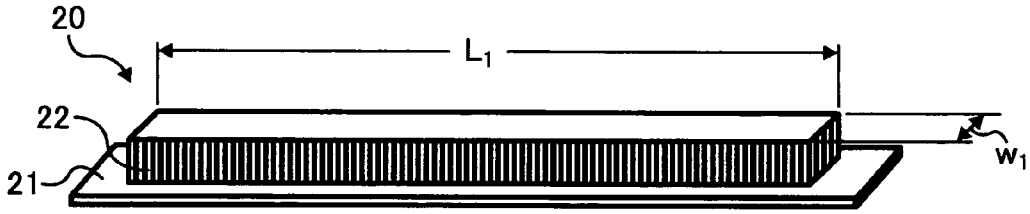
FIG. 7 a perspective view of the transfer brush of FIG. 6.

In FIG. 7, the brushing fiber portion 22 has a brush length "L1" of 297.5 mm in the longitudinal direction thereof. The brush length "L1" corresponds to a distance of the brushing fiber portion 22 in the belt width direction.

The metallic holder 21 has a planar member 24 thereon. The planar member 24 includes an insulating material thereon in a cantilever manner. The free end of the planar member 24 is held in contact with one end portion of the brushing fiber portion 22 in the belt moving direction at a position approximately 2 mm lower than the fiber tips of the brushing fiber portion 22.

Figure 6:
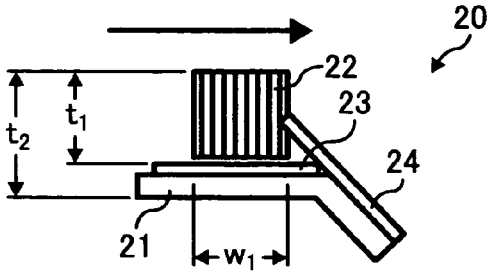
FIG. 6 is a cross sectional view of a transfer brush included in the transfer device of FIG. 4.

The sheet conveying belt 11 moves in the direction indicated by the arrow in FIG. 6 while the tip of the brushing fiber portion 22 is held in contact with the inner surface of the sheet conveying belt 11. At this time, the raised fibers of the brushing fiber portion 22 may bend along with the movement of the sheet conveying belt 11. The planar member 24 is used to reduce or prevent the excess bend of the raised fibers of the brushing fiber portion 22.

As described above, the inventor of the present invention prepared the plurality of transfer brushes 20 having the same structure according to FIGS. 6 and 7 and having different electrical resistance characteristics.

Each of the raised fibers forming the brushing fiber portion 22 of the transfer brush 20 is formed by a material including carbon powder. The carbon powder is a conductive electrical resistance controller in a base material of rayon or nylon.

When the raised fibers of the transfer brush 20 are formed by a material including the carbon powder in the base material of rayon, the transfer brush 20 is hereinafter referred to as a "rayon transfer brush 20." When the raised fibers of the transfer brush 20 are formed by a material including the carbon powder in the base material of nylon, the transfer brush 20 is hereinafter referred to as a "nylon transfer brush 20."

The rayon is a regenerated fiber obtained by dissolving cellulose to prepare a colloidal solution thereof, and then extruding the colloidal solution from fine pores into a congealed liquid.

The nylon is a fiber made of a synthesized straight-chain polyamide, of which the main chain includes repeating units including an amide group. In the fiber, the repeating units are arranged in the axial direction.

The inventor of the present invention measured the previously prepared transfer brushes 20 to obtain a brush VI value, a sectional scanned current value, a ripple in the sectional scanned current value, a drum-side scanned current value, and an electrical resistance value per unit length of a raised fiber.

The brush VI value is a value of a total transfer current provided on the entire surface formed by the fiber tips of the plurality of raised fibers of the transfer brush 20. The above-described surface is hereinafter referred to as a "brush surface." An electrode having the same area as the entire brush surface is used to measure the brush VI value.

The sectional scanned current value is a value of sectional transfer current provided on the brush surface of the transfer brush 20. The sectional scanned current value is obtained by sequentially scanning the entire brush surface by a predetermined portion or section thereof at the intervals of a predetermined speed. A small-sized electrode having the area corresponding to the size of the predetermined section of the brush surface is used to measure the sectional scanned current value. The maximum value of the sectional scanned current values is hereinafter referred to as "the maximum sectional scanned current value."

The ripple in the sectional scanned current value is expressed in a unit of percentage and is obtained by an expression of (the maximum sectional scanned current value−the mean value)/the mean value*100%.

The drum-side scanned current value is a value of sectional transfer current provided on the brush surface on the photoconductive drum side. The drum-side scanned current value is obtained by sequentially scanning the partial brush surface on the photoconductive drum side portion, or section thereof, at the intervals of a predetermined speed. A small-sized electrode having the area corresponding to the size of the predetermined section of the brush surface, half covered by an insulating material, is used to measure the drum-side scanned current value. The maximum value of the drum-side scanned current values is hereinafter referred to as "the maximum drum-side scanned current value."

The electrical resistance value per unit length of a single fiber is a mean value of electrical resistances per unit length of 100 fibers.

Referring to FIGS. 8 to 11, the measurements performed with respect to the respective values are described.

Figure 8:
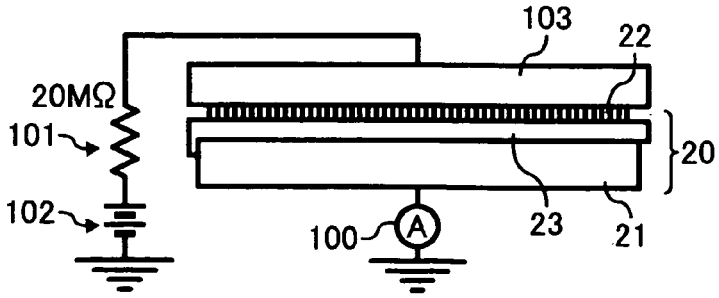
FIG. 8 is a schematic diagram showing a method of measuring a brush VI value of the transfer brush.

The brush VI value is measured using a measurement structure as shown in FIG. 8.

As shown in FIG. 8, the transfer brush 20 includes the brush surface formed by the fiber tips of the plurality of raised fibers.

The entire brush surface of the transfer brush 20 is held in contact with an electrode block 103, formed of stainless steel (SUS304), having the size corresponding to the entire brush surface. The electrode block 103 is connected with a biasing source 102 via a wire, and an electrical resistance 101 having a value of 20 MΩ is provided between the biasing source 102 and the electrode block 103. The metallic holder 21, which is formed of stainless steel (SUS304), of the transfer brush 20 is grounded via an ampere meter 100.

With the above-described structure, an amount of 2 kV of a direct bias is applied between the electrical resistance 101 and the metallic holder 21 connected to the ampere meter 100. After one minute has elapsed since the application of the direct bias, the current measured by the ampere meter 100 is read or scanned as the brush VI value.

While contacting the entire length in the longitudinal direction of the brush surface, the electrode block 103 is also held in contact with the entire width in the belt moving direction of the brush surface, which is not shown.

The wire extending from the electrical resistance 101 to the electrode block 103 is attached or screwed to the electrode block 103.

The wire extending from the ampere meter 100 to the metallic holder 21 is attached or screwed to the metallic holder 21.

Figure 9:
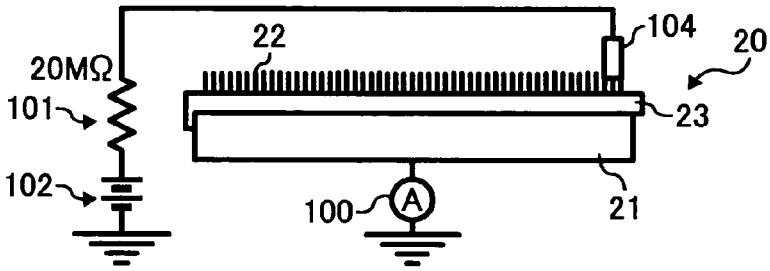
FIG. 9 is a schematic diagram showing a method of measuring sectional scanned current values of the transfer brush.

The sectional scanned current values are measured using a measurement structure as shown in FIG. 9.

As shown in FIG. 9, a small electrode block 104 is held in contact with one end portion of the brush surface of the transfer brush 20. The small electrode block 104 has an area contacting with the brush surface in the size of 10 mm×10 mm. The small electrode block 104 is connected with the biasing source 102 via a wire, and the electrical resistance 101 having a value of 20 MΩ is provided between the biasing source 102 and the small electrode block 104. The metallic holder 21 of the transfer brush 20 is grounded via the ampere meter 100.

With the above-described structure, an amount of 2 kV of a direct bias is applied between the electrical resistance 101 and the metallic holder 21 connected to the ampere meter 100. The small electrode block 104 held in contact with the brush surface is then moved at a speed of 10 mm/sec from one end portion to the other end portion of the brushing fiber portion 22 in the longitudinal direction thereof, which is the belt width direction of the sheet conveying belt 11. While moving in the longitudinal direction of the brushing fiber portion 22 of the transfer brush 20, the small electrode block 104 sequentially reads or scans respective sectional current values measured by the ampere meter 100 as the sectional scanned current values.

The small electrode block 104 has the contact length of 10 mm with respect to the brush surface in the longitudinal direction of the brushing fiber portion 22.

Figure 10:
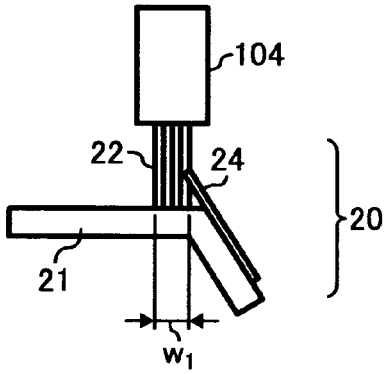
FIG. 10 is a lateral view of the transfer brush with an electrode block attached thereon.

Further, as shown in FIG. 10, the small electrode block 104 is held in contact with the entire width of the brush surface, which is the entire brush width "W1" of 5 mm, in the belt moving direction.

The ampere meter 100 is controlled to scan or read each sectional current value at the speed of 100 [number of scans/sec]. Specifically, each sectional current value is scanned at each movement of the small electrode block 104 by 0.1 mm.

The measurement of the ripple in the sectional scanned current value is described below.

To obtain the ripple in the sectional scanned current values, the mean value of the sectional scanned current values is obtained based on the sectional scanned current values and the number of scans. Hereinafter, the mean value of the sectional scanned current values is referred to as a "mean scanned current value." In addition, the maximum value of the sectional scanned current values is specified based on the sectional scanned current values. Hereinafter, the maximum value of the sectional scanned current values is referred to as "the maximum sectional scanned current value." The mean scanned current value of the sectional scanned current values and the maximum sectional scanned current value are assigned to the expression, "(maximum sectional scanned current value−mean scanned current value)/mean scanned current value*100%". Thus, the ripple in the sectional scanned current values in a unit of percentage (%) can be obtained.

Figure 11:
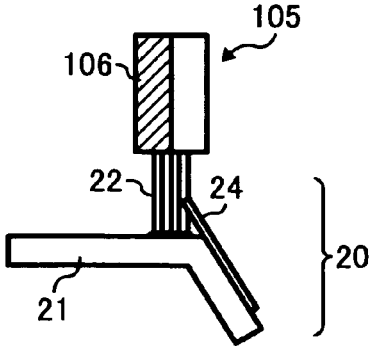
FIG. 11 is a schematic diagram showing a method of measuring sectional scanned current values of the transfer brush on an image bearing member side.

The drum-side scanned current value, which is a value of a transfer current provided on the partial brush surface close to the photoconductive drum side, is measured using a measurement structure as shown in FIG. 11.

As shown in FIG. 11, a small electrode block 105, formed of stainless steel, is held in contact with the brush surface of the transfer brush 20. The small electrode block 105 has two sections vertically divided in the width direction of the transfer brush 20. An insulating tape 106 is attached to one section of the small electrode block 105, shown on the left side in FIG. 11, while the other section thereof, shown on the right side in FIG. 11, remains unattached.

While the small electrode block 105 is held in contact with the brush surface as shown in FIG. 11, the direct bias is applied to the right section of the small electrode block 105, which is located closer than the left section thereof with respect to the photoconductive drum 1.

With the above-described structure, the small electrode block 105 held in contact with the brush surface is moved from one end portion to the other end portion of the brushing fiber portion 22 in the longitudinal direction thereof, which is the same operation performed to obtain the sectional scanned current values. While moving in the longitudinal direction of the brushing fiber portion 22 of the transfer brush 20, the small electrode block 105 sequentially scans and reads respective current values measured by the ampere meter 100 as the drum-side scanned current values.

The measurement of the electric resistance value per unit length of a raised fiber is described below. The electric resistance value per unit length of a raised fiber is hereinafter referred to as a "fiber resistance value."

To obtain the fiber resistance value, the raised fibers are randomly pulled out from the transfer brush 20, in a unit of 100 pieces, after the experiments described below are completed. The respective electric resistance values of the pulled out raised fibers are measured and converted to the resistance value per unit length of the raised fiber so as to obtain the mean value per 100 raised fibers as the fiber resistance value. The fiber resistance value of each fiber is obtained with respect to the entire transfer brush 20.

The electrical resistance value of the entire length of a raised fiber is obtained through the measurement described below.

Metallic clips are attached to both ends of a raised fiber. The distance between the metallic clips are adjusted, and then a tension force of from approximately 100 gf to approximately 200 gf is applied to the raised fiber. With the above-described condition, a bias of 200V is applied to the metallic clips. After one minute has elapsed since the application of the bias, the current value measured by an ampere meter is read or scanned. Based on the result of the measurement, the electrical resistance value of the entire length of the raised fiber is obtained.

[Preparation 2 Before Experiments]

Figure 12:
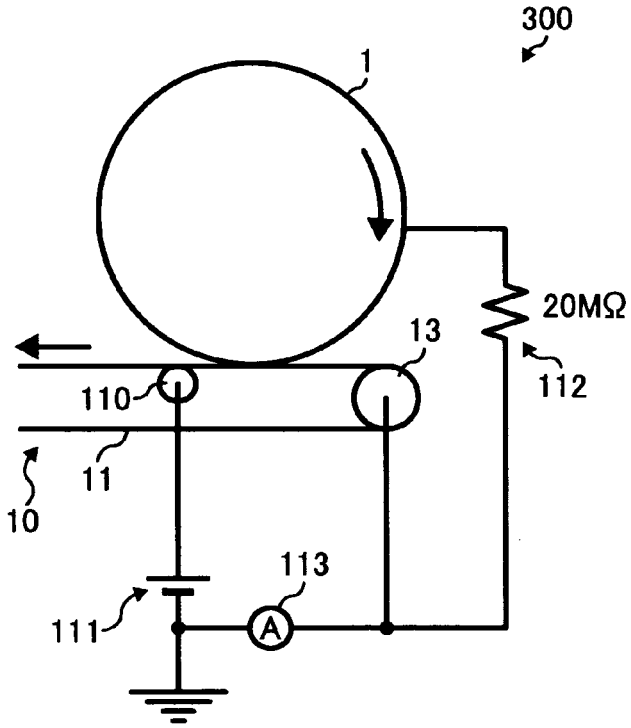
FIG. 12 a schematic diagram showing a method of measuring a belt VI value of a belt member included in the transfer device.

Referring to FIG. 12, a schematic structure of a printer 300 is described.

The printer 300 has a similar structure to that of printer 200 shown in FIG. 3, except that the printer 300 includes one of a plurality of sheet conveying belts as sheet conveying belt 11. Each of the plurality of sheet conveying belts have different electrical resistance characteristics. For the plurality of sheet conveying belts, respective belt VI values thereof are measured as described below.

The sheet conveying belt 11 is attached to the printer 300 before mounting the transfer brush 20. As shown in FIG. 12, a metallic roller 110 is held in contact with the inner surface of the sheet conveying belt 11. The metallic roller 110 is held in contact with the same area as the transfer brush 20 in the printer 200 of FIG. 3. The shaft of the metallic roller 110 is connected with a biasing source 111 via a first wire. A second wire connected with the metallic shaft of the photoconductive drum 1 and a third wire connected to the driven roller 13 are connected to each other at a connecting point. An electrical resistance 112 having a value of 20 MΩ is provided between the above-described connecting point and the metallic shaft of the photoconductive drum 1. The connecting point is grounded via an ampere meter 113, and the sheet conveying belt 11 and the photoconductive drum 1 of the printer 300 are driven at the same linear velocity as the printer 200.

With the above-described structure, the biasing source 111 applies an amount of 2 kV of a direct bias between the metallic roller 110 and the ampere meter 113. After one minute has elapsed since the application of the direct bias, the current value measured by the ampere meter 113 is read and scanned. Thus, the belt VI value is obtained.

The linear velocity of the sheet conveying belt 11 and the photoconductive drum 1 of an actual printer or the printer 200 is set to a value in the range from approximately 400 mm/sec to approximately 650 mm/sec.

The target current value of the constant current control is set to a value in the range from approximately 85 μA to approximately 150 μA.

In the experiments for evaluating ranks of black streaks in the belt moving direction, which will be described later, the linear velocity is set to 500 mm/sec, and the target value of the transfer current is set to 110 μA.

[Experiment 1]

The printer 300 is provided with one of the plurality of transfer brushes 20 and one of the plurality of sheet conveying belts 11. The target value of the transfer current is set to the value in the range from approximately 85 μA to approximately 150 μA, and the constant current is controlled. Concurrently with the above-described settings, test patterns are printed out to examine whether the sharp change in image density is observed on the respective halftone areas of the printed test pattern images. Each test pattern is formed by a solid halftone area in the size of 2×2 (two by two) and printed on the entire surface of an A3-size transfer sheet.

The printed test pattern images are evaluated to determine whether any sharp change in image density is visible or can be observed on the respective solid halftone area thereof. The evaluation is repeatedly performed by changing the transfer brush 20 and the sheet conveying belt 11 accordingly.

Consequently, the inventor of the present invention has found that the transfer brush 20 having a relatively small brush VI value can reduce the possibility of sharp changes in image density. In addition, the inventor of the present invention has found that the sheet conveying belt 11 having an approximately median resistance that relatively increases the belt VI value can reduce sharp changes in image density.

[Experiment 2]

Under the same conditions of Experiment 1, the test patterns are printed out to examine whether any sharp change in image density is observed on the respective halftone areas of the printed test pattern images. Concurrently with the above-described examination, black streaks in the belt moving direction that are observed on the halftone areas of the test pattern images are evaluated or ranked in five steps from Rank 1 to Rank 5.

The ranking of the black streaks in the belt moving direction is determined by visual examinations by person.

Figure 13:
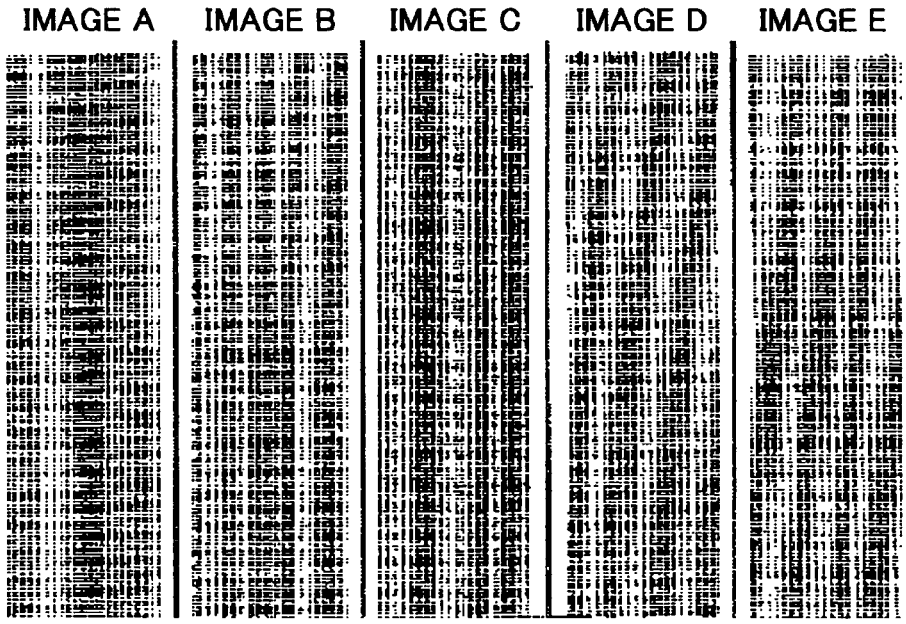
FIG. 13 show images corresponding to ranks indicating respective levels of black streams caused on a halftone area of a recording medium in a belt moving direction.

FIG. 13 shows Images A, B, C, D, and E of printed test patterns having respective black streaks in the belt moving direction. Images A, B, C, D, and E of printed test patterns are evaluated and ranked in Ranks 1, 2, 3, 4, and 5, respectively. Specifically, the black streaks on Image A correspond to Rank 1, which has a distance of approximately 3.0 mm in the belt width direction. The black streaks on Image B correspond to Rank 2, which has a distance of approximately 2.5 mm in the belt width direction. The black streaks on Image C correspond to Rank 3, which has a distance of approximately 2.0 mm in the belt width direction. The black streaks on Image D correspond to Rank 4, which has a distance of approximately 1.5 mm in the belt width direction. The black streaks on Image E correspond to Rank 5, which has a distance of approximately 1.0 mm in the belt width direction.

The above-described ranking of the black streaks in the belt moving direction shows that the amount of the black streaks in the belt moving direction becomes smaller as the level of the ranking becomes greater. It is difficult to find the black steaks on the test pattern images in Rank 4 or above unless the person making the examination looks closely at the test pattern. That is, the test pattern images in Rank 4 or above fall on the tolerance level thereof. Accordingly, the test pattern images in Rank 4 or above can effectively reduce the black streaks in the belt moving direction in the experiments described below.

Table 1 shows the results obtained through Experiments 1 and 2 performed by a test printer with the sheet conveying belt 11 having the belt VI value in the range from approximately 70 μA to approximately 95 μA and the transfer brush 20 having the base resin of the fibers formed by a nylon material such as nylon6. The result values in Table 1 show the relationship of the brush VI value, the maximum sectional scanned current value, the ranking of the black streaks in the belt moving direction, and the occurrence of sharp changes in image density. The relationship shown in Table 1 is plotted on the graph of FIG. 14.

Figure 14:
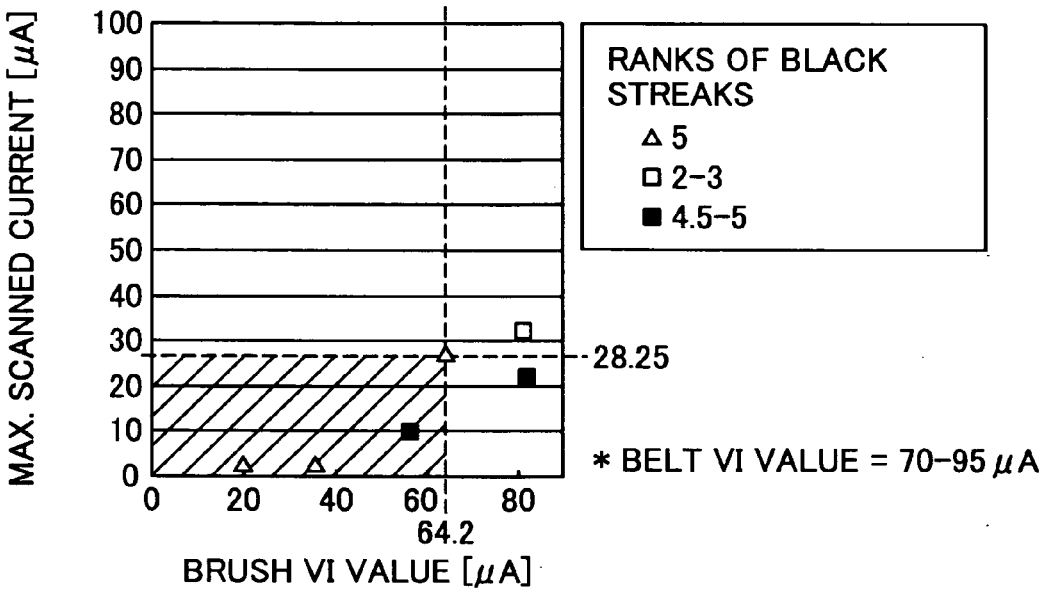
FIG. 14 is a graph showing the relationship of the brush VI value and the maximum scanned current value when the transfer device employs the belt member having the belt VI value in the range from approximately 70 μA to approximately 95 μA and the transfer brush including a nylon material.
Figure 15:
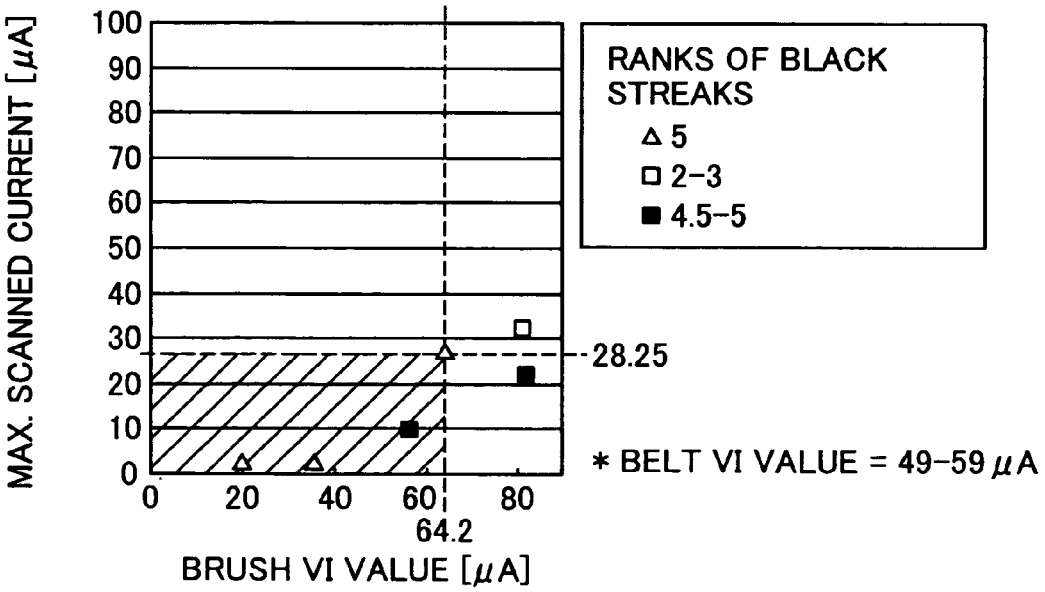
FIG. 15 is a graph showing the relationship of the brush VI value and the maximum scanned current value when the transfer device employs the belt member having the belt VI value in the range from approximately 49 μA to approximately 59 μA and the transfer brush including a nylon material.
Figure 16:
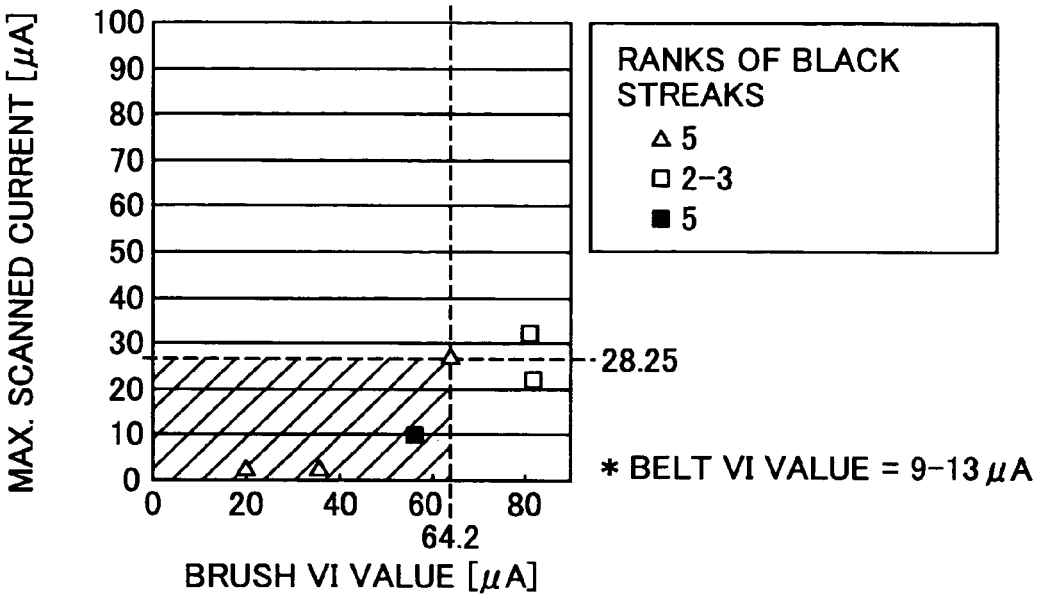
FIG. 16 is a graph showing the relationship of the brush VI value and the maximum scanned current value when the transfer device employs the belt member having the belt VI value in the range from approximately 9 μA to approximately 13 μA and the transfer brush including a nylon material.
Figure 17:
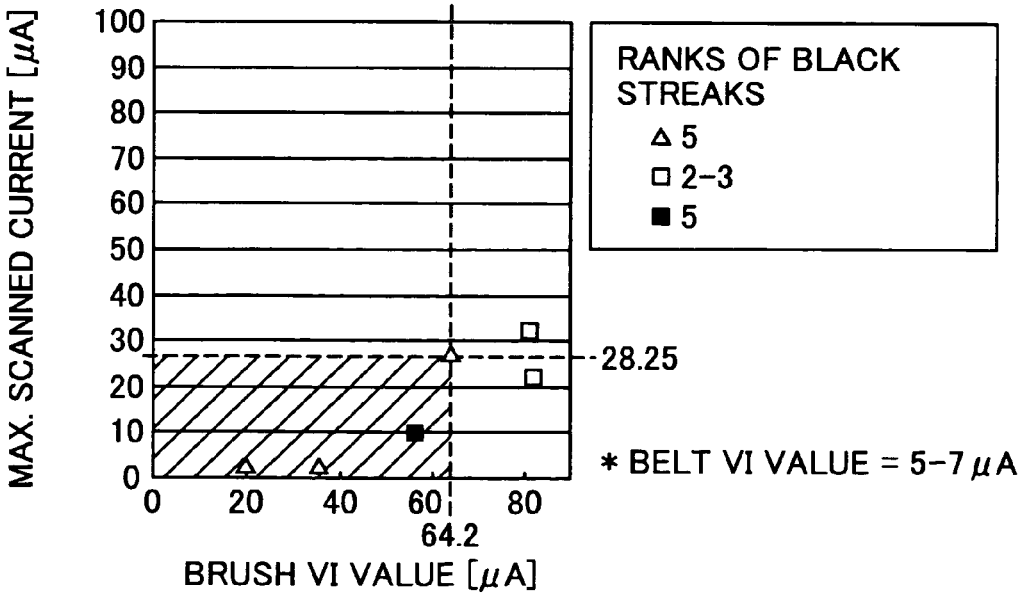
FIG. 17 is a graph showing the relationship of the brush VI value and the maximum scanned current value when the transfer device employs the belt member having the belt VI value in the range from approximately 5 μA to approximately 7 μA and the transfer brush including a nylon material.
Figure 18:
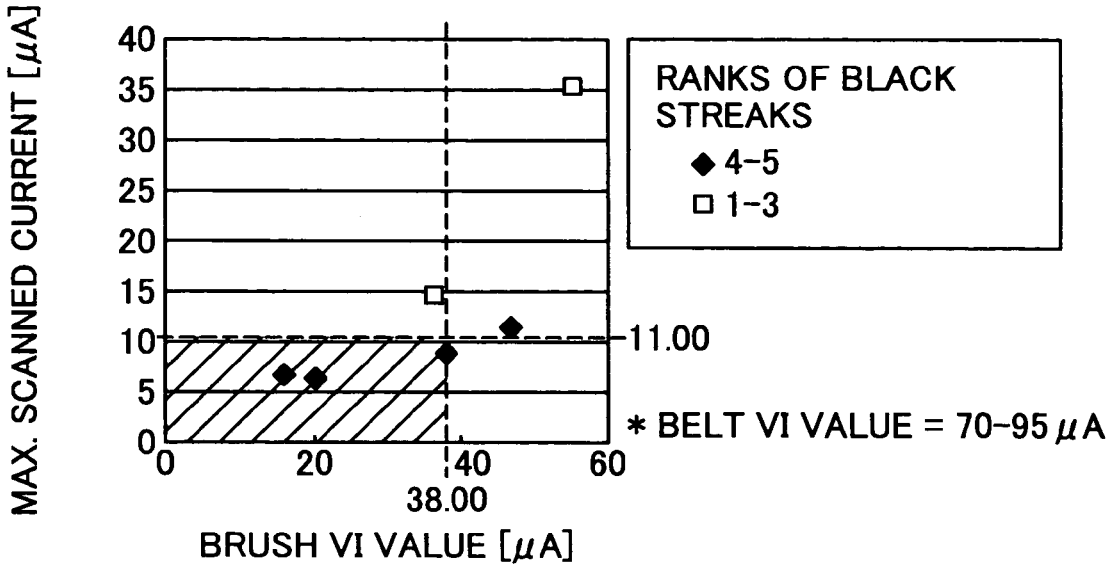
FIG. 18 is a graph showing the relationship of the brush VI value and the maximum scanned current value when the transfer device employs the belt member having the belt VI value in the range from approximately 70 μA to approximately 95 μA and the transfer brush including a rayon material.
Figure 19:
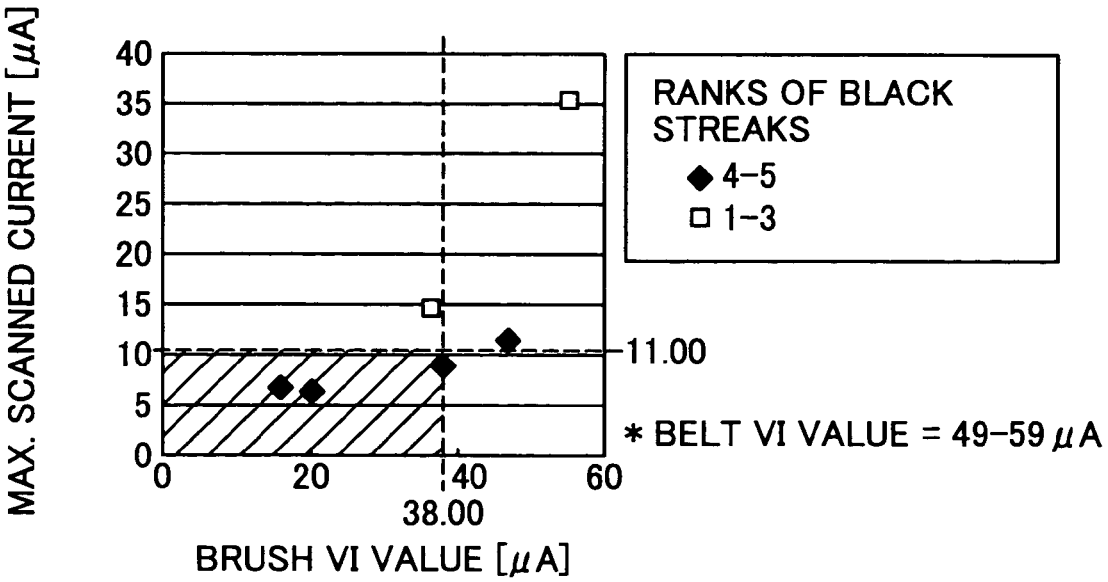
FIG. 19 is a graph showing the relationship of the brush VI value and the maximum scanned current value when the transfer device employs the belt member having the belt VI value in the range from approximately 49 μA to approximately 59 μA and the transfer brush including a rayon material.
Figure 20:
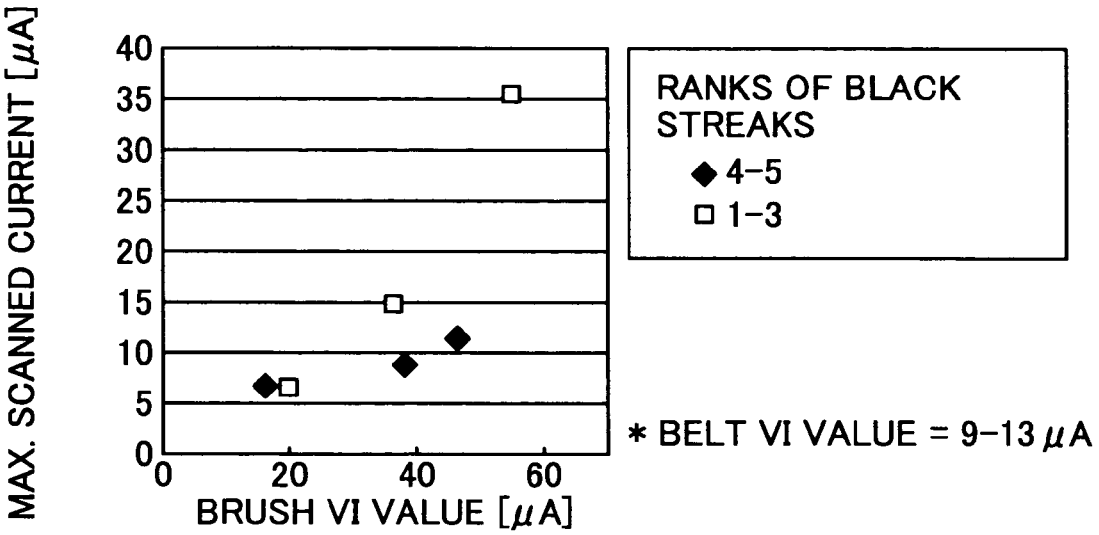
FIG. 20 is a graph showing the relationship of the brush VI value and the maximum scanned current value when the transfer device employs the belt member having the belt VI value in the range from approximately 9 μA to approximately 13 μA and the transfer brush including a rayon material.
Figure 21:
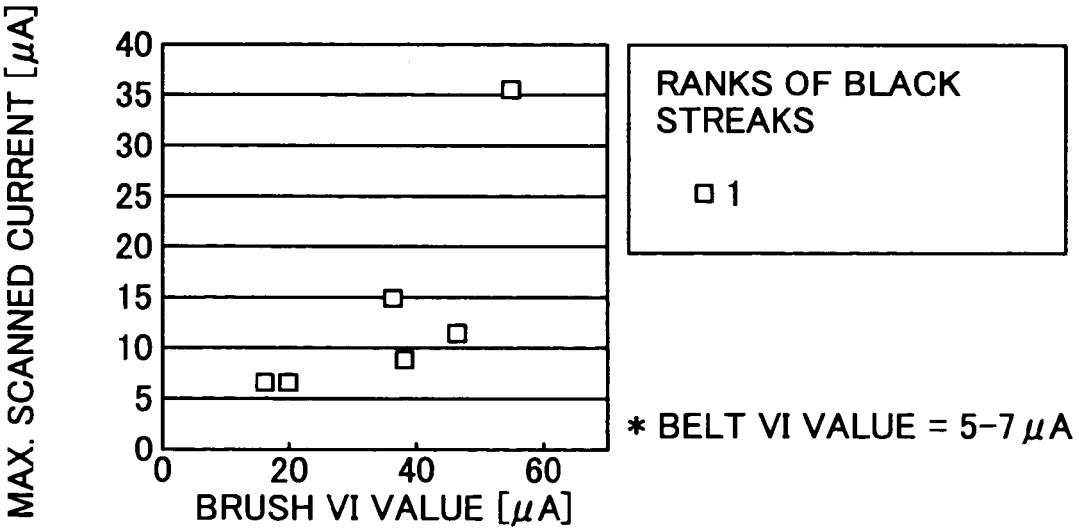
FIG. 21 is a graph showing the relationship of the brush VI value and the maximum scanned current value when the transfer device employs the belt member having the belt VI value in the range from approximately 5 μA to approximately 7 μA and the transfer brush including a rayon material.
Figure 22:
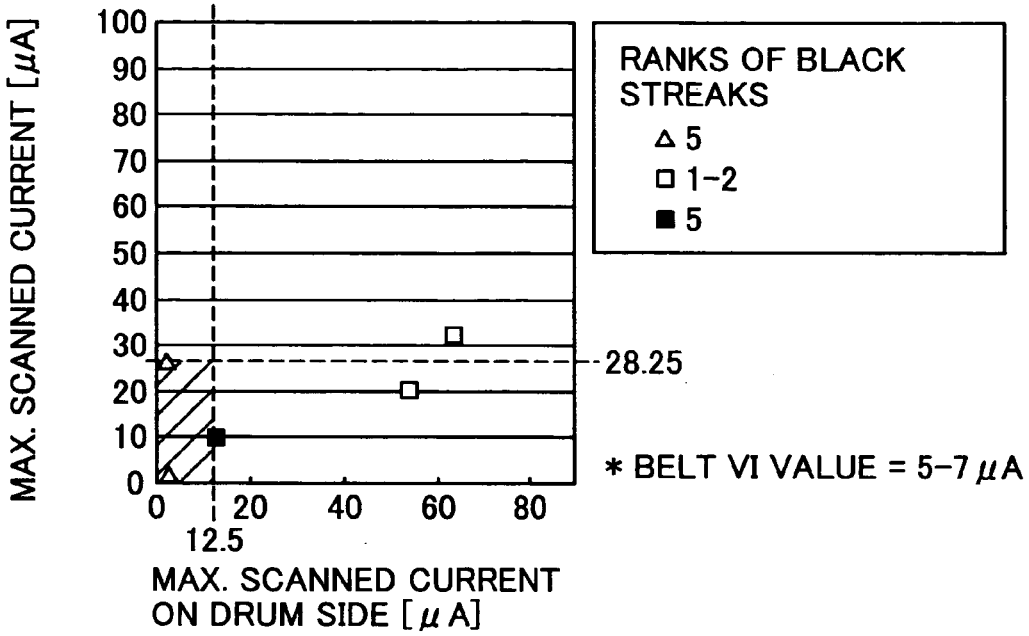
FIG. 22 is a graph showing the relationship of the maximum scanned current value and the maximum scanned current value on the image bearing member side when the transfer device employs the belt member having the belt VI value in the range from approximately 5 μA to approximately 7 μA and the transfer brush including a nylon material.
Figure 23:
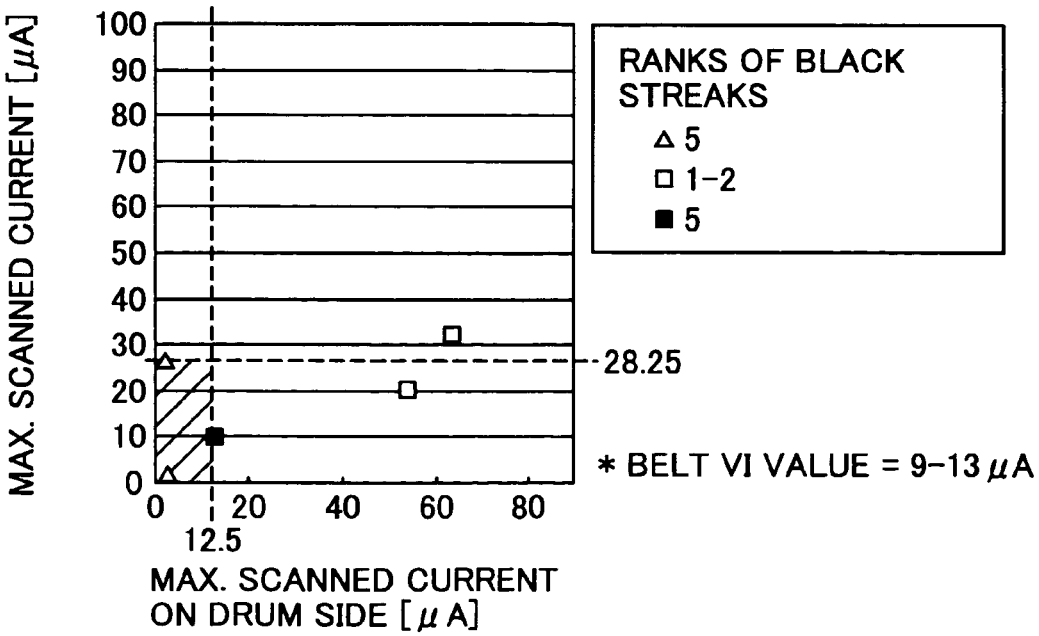
FIG. 23 is a graph showing the relationship of the maximum scanned current value and the maximum scanned current value on the image bearing member side when the transfer device employs the belt member having the belt VI value in the range from approximately 9 μA to approximately 13 μA and the transfer brush including a nylon material.
Figure 24:
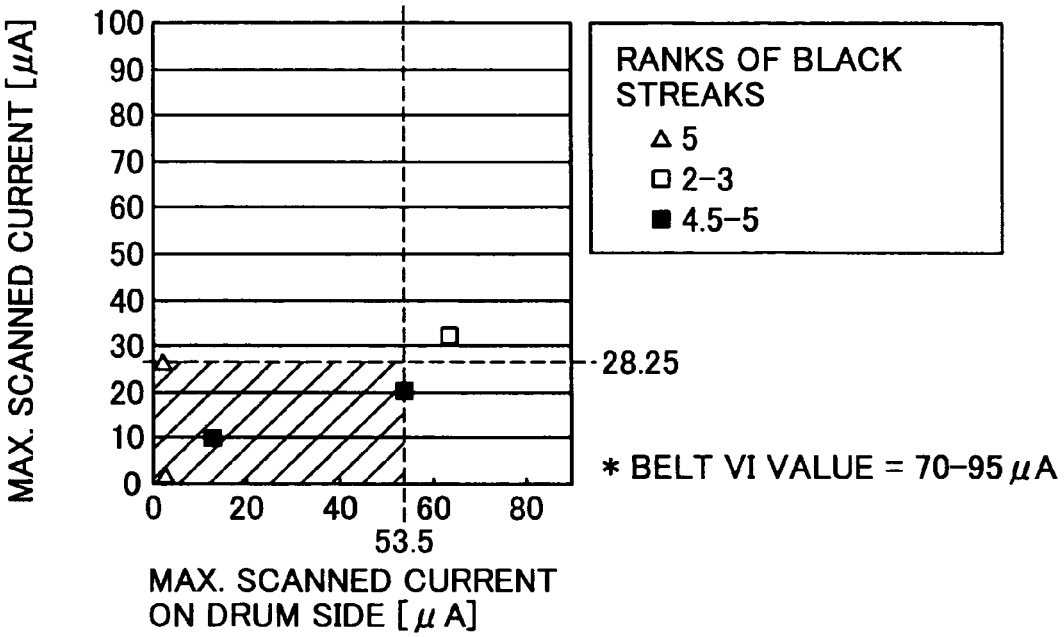
FIG. 24 is a graph showing the relationship of the maximum scanned current value and the maximum scanned current value on the image bearing member side when the transfer device employs the belt member having the belt VI value in the range from approximately 70 μA to approximately 95 μA and the transfer brush including a nylon material.
Figure 25:
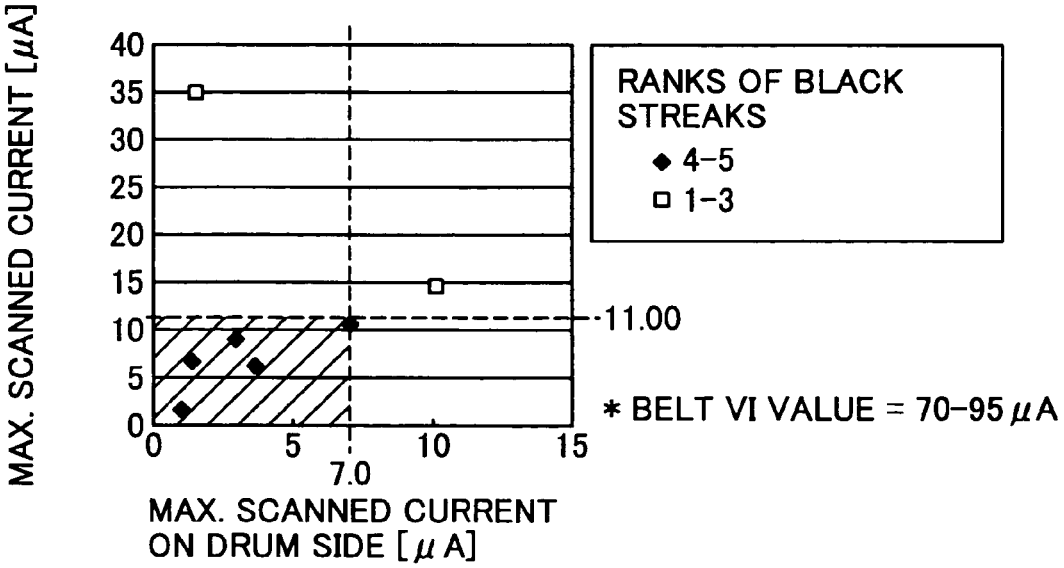
FIG. 25 is a graph showing the relationship of the maximum scanned current value and the maximum scanned current value on the image bearing member side when the transfer device employs the belt member having the belt VI value in the range from approximately 70 μA to approximately 95 μA and the transfer brush including a rayon material.
Figure 26:
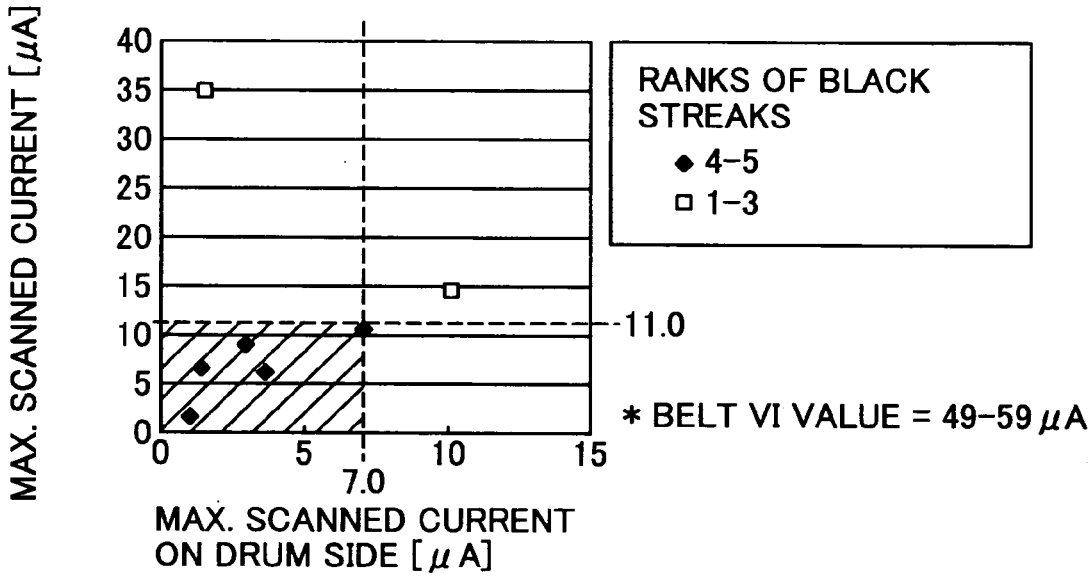
FIG. 26 is a graph showing the relationship of the maximum scanned current value and the maximum scanned current value on the image bearing member side when the transfer device employs the belt member having the belt VI value in the range from approximately 49 μA to approximately 59 μA and the transfer brush including a rayon material.
Figure 27:
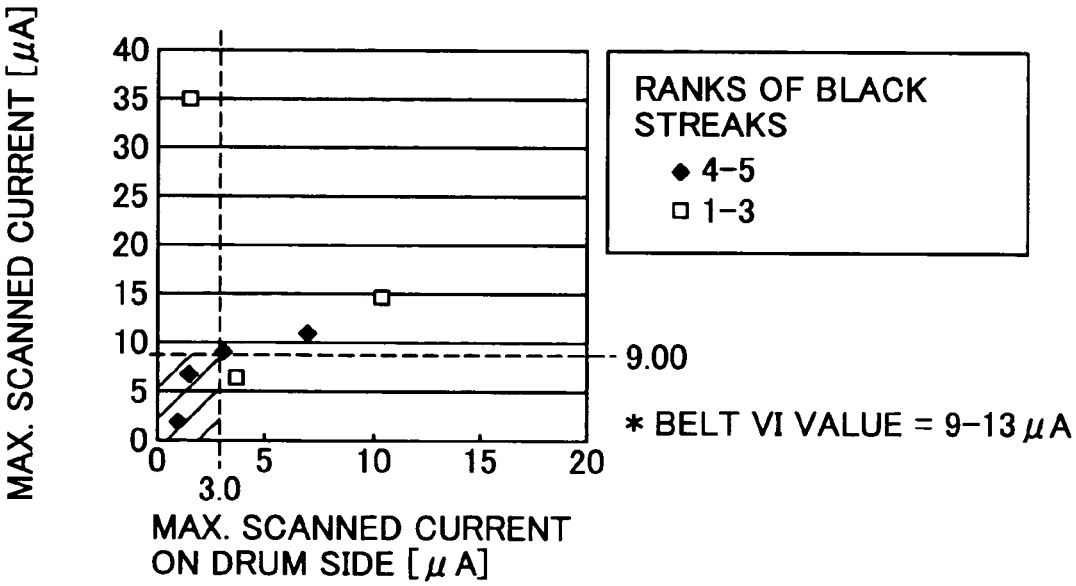
FIG. 27 is a graph showing the relationship of the maximum scanned current value and the maximum scanned current value on the image bearing member side when the transfer device employs the belt member having the belt VI value in the range from approximately 9 μA to approximately 13 μA and the transfer brush including a rayon material.

The area with diagonal lines on the graph of FIG. 14 is an area that can effectively reduce the amount of black streaks in the belt moving direction, and simultaneously can reduce the visible sharp changes in image density. The above-described area is also applied to the graphs shown in FIGS. 15 to 28 described later.

"The belt VI value in the range from approximately 70 μA to approximately 95 μA", for example, means that a plurality of measured values fall in the range from approximately 70 μA to approximately 95 μA when the belt VI values are measured over a plurality of locations of the sheet conveying belt 11 in the belt moving direction.

TABLE 1

| BRUSH VI VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 30.0 | 2.50 | RANK 5 | NO |
| 35.5 | 2.75 | RANK 5 | NO |
| 56.0 | 10.25 | RANK 4.5-5 | NO |
| 64.2 | 28.25 | RANK 5 | NO |
| 81.0 | 32.50 | RANK 2-3 | YES |
| 82.0 | 22.25 | RANK 4.5-5 | NO |

Table 2 shows the results obtained through Experiments 1 and 2 performed by a test printer with the sheet conveying belt 11 having the belt VI value in the range from approximately 49 μA to approximately 59 μA and the transfer brush 20 having the base resin of the fibers formed by a nylon material such as nylon6. The result values in Table 2 show the relationship of the brush VI value, the maximum sectional scanned current value, the ranking of the black streaks in the belt moving direction, and the occurrence of sharp changes in image density. The relationship shown in Table is plotted on the graph of FIG. 15.

TABLE 2

| BRUSH VI VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 30.0 | 2.50 | RANK 5 | NO |
| 35.5 | 2.75 | RANK 5 | NO |
| 56.0 | 10.25 | RANK 4.5-5 | NO |
| 64.2 | 28.25 | RANK 5 | NO |
| 81.0 | 32.50 | RANK 2-3 | YES |
| 82.0 | 22.25 | RANK 4.5-5 | NO |

Table 3 shows the results obtained through Experiments 1 and 2 performed by a test printer with the sheet conveying belt 11 having the belt VI value in the range from approximately 9 μA to approximately 13 μA and the transfer brush 20 having the base resin of the fibers formed by a nylon material such as nylon6. The result values in Table 3 show the relationship of the brush VI value, the maximum sectional scanned current value, the ranking of the black streaks in the belt moving direction, and the occurrence of sharp changes in image density. The relationship shown in Table 3 is plotted on the graph of FIG. 16.

TABLE 3

| BRUSH VI VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 20.0 | 2.50 | RANK 5 | NO |
| 35.5 | 2.75 | RANK 5 | NO |
| 56.0 | 10.25 | RANK 5 | NO |
| 64.2 | 28.25 | RANK 5 | NO |
| 81.0 | 32.50 | RANK 1-2 | YES |
| 82.0 | 22.25 | RANK 1-2 | NO |

Table 4 shows the results obtained through Experiments 1 and 2 performed by a test printer with the sheet conveying belt 11 having the belt VI value in the range from approximately 5 μA to approximately 7 μA and the transfer brush 20 having the base resin of the fibers formed by a nylon material such as nylon6. The result values in Table 4 show the relationship of the brush VI value, the maximum sectional scanned current value, the ranking of the black streaks in the belt moving direction, and the occurrence of sharp changes in image density. The relationship shown in Table 4 is plotted on the graph of FIG. 17.

TABLE 4

| BRUSH VI VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 20.0 | 2.50 | RANK 5 | NO |
| 35.5 | 2.75 | RANK 5 | NO |
| 56.0 | 10.25 | RANK 5 | NO |
| 64.2 | 28.25 | RANK 5 | NO |
| 81.0 | 32.50 | RANK 1-2 | YES |
| 82.0 | 22.25 | RANK 1-2 | NO |

Table 5 shows the results obtained through Experiments 1 and 2 performed by a test printer with the sheet conveying belt 11 having the belt VI value in the range from approximately 70 μA to approximately 95 μA and the transfer brush 20 having the base resin of the fibers formed by a rayon material. The result values in Table 5 show the relationship of the brush VI value, the maximum sectional scanned current value, the ranking of the black streaks in the belt moving direction, and the occurrence of sharp changes in image density. The relationship shown in Table 5 is plotted on the graph of FIG. 18.

TABLE 5

| BRUSH VI VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 16.1 | 6.75 | RANK 4-5 | NO |
| 20.1 | 6.25 | RANK 4-5 | NO |
| 38.0 | 9.00 | RANK 4-5 | NO |
| 46.8 | 11.00 | RANK 4-5 | NO |
| 36.0 | 14.50 | RANK 1-3 | YES |
| 54.8 | 35.25 | RANK 1-3 | YES |

Table 6 shows the results obtained through Experiments 1 and 2 performed by a test printer with the sheet conveying belt 11 having the belt VI value in the range from approximately 49 μA to approximately 59 μA and the transfer brush 20 having the base resin of the fibers formed by a rayon material. The result values in Table 6 show the relationship of the brush VI value, the maximum sectional scanned current value, the ranking of the black streaks in the belt moving direction, and the occurrence of sharp changes in image density. The relationship shown in Table 6 is plotted on the graph of FIG. 19.

TABLE 6

| BRUSH VI VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 16.1 | 6.75 | RANK 4-5 | NO |
| 20.1 | 6.25 | RANK 4-5 | NO |
| 38.0 | 9.00 | RANK 4-5 | NO |
| 46.8 | 11.00 | RANK 4-5 | NO |
| 36.0 | 14.50 | RANK 1-3 | YES |
| 54.8 | 35.25 | RANK 1-3 | YES |

Table 7 shows the results obtained through Experiments 1 and 2 performed by a test printer with the sheet conveying belt 11 having the belt VI value in the range from approximately 9 μA to approximately 13 μA and the transfer brush 20 having the base resin of the fibers formed by a rayon material. The result values in Table 7 show the relationship of the brush VI value, the maximum sectional scanned current value, the ranking of the black streaks in the belt moving direction, and the occurrence of sharp changes in image density. The relationship shown in Table 7 is plotted on the graph of FIG. 20.

TABLE 7

| BRUSH VI VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 16.1 | 6.75 | RANK 4-5 | YES |
| 38.0 | 9.00 | RANK 4-5 | YES |
| 46.8 | 11.00 | RANK 4-5 | YES |
| 20.1 | 62.50 | RANK 1-3 | YES |
| 36.0 | 14.50 | RANK 1-3 | YES |
| 54.8 | 35.25 | RANK 1-3 | YES |

Table 8 shows the results obtained through Experiments 1 and 2 performed by a test printer with the sheet conveying belt 11 having the belt VI value in the range from approximately 5 μA to approximately 7 μA and the transfer brush 20 having the base resin of the fibers formed by a rayon material. The result values in Table 8 show the relationship of the brush VI value, the maximum sectional scanned current value, the ranking of the black streaks in the belt moving direction, and the occurrence of sharp changes in image density. The relationship shown in Table 8 is plotted on the graph of FIG. 21.

TABLE 8

| BRUSH VI VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 16.1 | 6.75 | RANK 1 | YES |
| 38.0 | 9.00 | RANK 1 | YES |
| 46.8 | 11.00 | RANK 1 | YES |
| 20.1 | 62.50 | RANK 1 | YES |
| 36.0 | 14.50 | RANK 1 | YES |
| 54.8 | 35.25 | RANK 1 | YES |

Thus, the results of Experiments 1 and 2 shown in Tables 1 through 8 show the preferable condition of the transfer brush 20. Specifically, when the belt VI value of the sheet conveying belt 11 is in the appropriate range, it is preferable to use the transfer brush 20 having the brush VI value of the transfer brush 20 equal to or smaller than 38.0 μA and the maximum sectional scanned current value equal to or smaller than 11.00 μA. With the above-described conditions, the black streaks in the belt moving direction and the sharp changes in image density can effectively be reduced or prevented, regardless of the base resin of the raised fibers (rayon or nylon).

Even through the raised fibers are formed by the same base resin, the entire electrical resistances of the plurality of transfer brushes 20 may be different when the brushing fiber portion 22 varies in the size of the brush surface. For this reason, the brush VI values and the sectional scanned current values are converted into the corresponding values per unit area of the brush surface so as to accurately describe the resistance characteristics of the entire transfer brush 20.

In Experiment 2, the brush VI value is measured while the electrode block 103 is held in contact with the entire brush surface of the brushing fiber portion 22 of the transfer brush 20. Therefore, the brush VI value per unit area of the brush surface can be obtained by dividing the brush VI value of the entire brush surface thereof by the entire brush surface.

For example, the brush VI value of 38.0 μA is calculated as follows: 38.0 [μA]+(0.5 [cm]×29.75 [cm])=2.55 [μA/cm$^2$]. Thus, the brush VI value per unit area becomes 2.55 μA/cm$^2$. As previously described, the smaller the brush VI value becomes, the lesser the possibility of causing the black streaks in the belt moving direction becomes. Accordingly, the hundredth place of the brush VI value per unit area is preferably rounded to be 2.5. Consequently, the brush VI value per unit area can be calculated to be 2.5 μA/cm$^2$ or smaller.

Further in Experiment 2, the sectional scanned current values are measured while the contact area (10 mm×10 mm) of the small electrode block 104 is held in contact with the entire brush surface having the brush width "W1" of 5 mm. Therefore, the maximum sectional scanned current value per unit area of the brush surface can be obtained by dividing the maximum sectional scanned current value of the predetermined section of the brush surface by the predetermined section of the brush surface.

For example, the maximum scanned current value of 11.00 μA is calculated as follows: 11.00 μA÷(0.5 cm×1.0 cm)=22.00 [μA/cm$^2$]. Thus, the maximum sectional scanned current value per unit area of the brush surface becomes 22.00 μA/cm$^2$. As previously described, the smaller the maximum sectional scanned current value becomes, the lesser the possibility of causing the black streaks in the belt moving direction becomes. Accordingly, the hundredth place of the maximum scanned current value per unit area is preferably rounded to be 22.0. Consequently, the maximum sectional scanned current value per unit area can be calculated to be 22.0 μA/cm$^2$ or smaller.

Hereinafter, the brush VI value converted per unit area of the brush surface of the transfer brush 20 is referred to as a "converted brush VI value", and the maximum sectional scanned current value converted per unit area of the brush surface of the transfer brush 20 is referred to as a "converted maximum sectional scanned current value."

In consideration of the above-described results, the printer according to the first exemplary embodiment of the present invention uses the transfer brush 20 having the converted brush VI value equal to or smaller than 2.5 μA/cm$^2$ and the converted maximum sectional scanned current value equal to or smaller than 22.0 μA/cm$^2$.

Table 9 shows the results obtained through Experiments 1 and 2 performed by a test printer with the sheet conveying belt 11 having the belt VI value in the range from approximately 5 μA to approximately 7 μA and the transfer brush 20 having the base resin of the fibers formed by a nylon material such as nylon6. The result values in Table 9 show the relationship of the maximum drum-side scanned current value, the maximum sectional scanned current value, the ranking of the black streaks in the belt moving direction, and the occurrence of sharp changes in image density. The relationship shown in Table 9 is plotted on the graph of FIG. 22.

TABLE 9

| MAX. DRUM-SIDE SCANNED CURRENT VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 1.75 | 2.50 | RANK 5 | NO |
| 2.0 | 2.75 | RANK 5 | NO |
| 12.5 | 10.25 | RANK 5 | NO |

TABLE 9-continued

| MAX. DRUM-SIDE SCANNED CURRENT VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 53.5 | 22.25 | RANK 1-2 | NO |
| 62.5 | 32.50 | RANK 1-2 | YES |

Table 10 shows the results obtained through Experiments 1 and 2 performed by a test printer with the sheet conveying belt 11 having the belt VI value in the range from approximately 9 μA to approximately 13 μA and the transfer brush 20 having the base resin of the fibers formed by a nylon material such as nylon6. The result values in Table 10 show the relationship of the maximum drum-side scanned current value, the maximum sectional scanned current value, the ranking of the black streaks in the belt moving direction, and the occurrence of sharp changes in image density. The relationship shown in Table 10 is plotted on the graph of FIG. 23.

TABLE 10

| MAX. DRUM-SIDE SCANNED CURRENT VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 1.75 | 2.50 | RANK 5 | NO |
| 2.0 | 2.75 | RANK 5 | NO |
| 12.5 | 10.25 | RANK 5 | NO |
| 53.5 | 22.25 | RANK 1-2 | NO |
| 62.5 | 32.50 | RANK 1-2 | YES |

Table 11 shows the results obtained through Experiments 1 and 2 performed by a test printer with the sheet conveying belt 11 having the belt VI value in the range from approximately 70 μA to approximately 95 μA and the transfer brush 20 having the base resin of the fibers formed by a nylon material such as nylon6. The result values in Table 11 show the relationship of the maximum drum-side scanned current value, the maximum sectional scanned current value, the ranking of the black streaks in the belt moving direction, and the occurrence of sharp changes in image density. The relationship shown in Table 11 is plotted on the graph of FIG. 24.

TABLE 11

| MAX. DRUM-SIDE SCANNED CURRENT VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 1.75 | 2.50 | RANK 5 | NO |
| 2.0 | 2.75 | RANK 5 | NO |
| 12.5 | 10.25 | RANK 4.5-5 | NO |
| 53.5 | 22.25 | RANK 4.5-5 | NO |
| 62.5 | 32.50 | RANK 2-3 | YES |

Table 12 shows the results obtained through Experiments 1 and 2 performed by a test printer with the sheet conveying belt 11 having the belt VI value in the range from approximately 70 μA to approximately 95 μA and the transfer brush 20 having the base resin of the fibers formed by a rayon material. The result values in Table 12 show the relationship of the maximum drum-side scanned current value, the maximum sectional scanned current value, the ranking of the black streaks in the belt moving direction, and the occurrence of sharp changes in image density. The relationship shown in Table 12 is plotted on the graph of FIG. 25.

TABLE 12

| MAX. DRUM-SIDE SCANNED CURRENT VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 1.00 | 1.75 | RANK 4-5 | NO |
| 1.5 | 6.75 | RANK 4-5 | NO |
| 1.5 | 35.25 | RANK 1-3 | YES |
| 3.0 | 9.00 | RANK 4-5 | NO |
| 3.75 | 6.25 | RANK 4-5 | NO |
| 7.0 | 11.00 | RANK 4-5 | NO |
| 10.25 | 14.50 | RANK 1-3 | YES |

Table 13 shows the results obtained through Experiments 1 and 2 performed by a test printer with the sheet conveying belt 11 having the belt VI value in the range from approximately 49 μA to approximately 59 μA and the transfer brush 20 having the base resin of the fibers formed by a rayon material. The result values in Table 13 show the relationship of the maximum drum-side scanned current value, the maximum sectional scanned current value, the ranking of the black streaks in the belt moving direction, and the occurrence of sharp changes in image density. The relationship shown in Table 13 is plotted on the graph of FIG. 26.

TABLE 13

| MAX. DRUM-SIDE SCANNED CURRENT VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 1.00 | 1.75 | RANK 4-5 | NO |
| 1.5 | 6.75 | RANK 4-5 | NO |
| 1.5 | 35.25 | RANK 1-3 | YES |
| 3.0 | 9.00 | RANK 4-5 | NO |
| 3.75 | 6.25 | RANK 4-5 | NO |
| 7.0 | 11.00 | RANK 4-5 | NO |
| 10.25 | 14.50 | RANK 1-3 | YES |

Table 14 shows the results obtained through Experiments 1 and 2 performed by a test printer with the sheet conveying belt 11 having the belt VI value in the range from approximately 9 μA to approximately 13 μA and the transfer brush 20 having the base resin of the fibers formed by a rayon material. The result values in Table 14 show the relationship of the maximum drum-side scanned current value, the maximum sectional scanned current value, the ranking of the black streaks in the belt moving direction, and the occurrence of sharp changes in image density. The relationship shown in Table 14 is plotted on the graph of FIG. 27.

TABLE 14

| MAX. DRUM-SIDE SCANNED CURRENT VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 1.00 | 1.75 | RANK 4-5 | NO |
| 1.5 | 6.75 | RANK 4-5 | NO |
| 1.5 | 35.25 | RANK 1-3 | YES |
| 3.0 | 9.00 | RANK 4-5 | NO |

TABLE 14-continued

| MAX. DRUM-SIDE SCANNED CURRENT VALUE [μA] | MAX. SECTIONAL SCANNED CURRENT VALUE [μA] | EVALUATION ON BLACK STREAKS IN BELT MOVING DIRECTION | SHARP CHANGES IN IMAGE DENSITY |
|---|---|---|---|
| 3.75 | 6.25 | RANK 1-3 | NO |
| 7.0 | 11.00 | RANK 4-5 | YES |
| 10.25 | 14.50 | RANK 1-3 | YES |

Thus, the results of Experiments 1 and 2 shown in Tables 9 through 14 show the preferable condition of the transfer brush 20. Specifically, it is preferable to use the transfer brush 20 having the brush VI value equal to or smaller than 38.0 μA, the maximum sectional scanned current value equal to or smaller than 11.00 μA, and the maximum drum-side scanned current value smaller than the maximum sectional scanned current value. When the transfer brush 20, having the above-described values is used, the black streaks in the belt moving direction can be ranked in a higher level. Therefore, the printer 200 according to the first exemplary embodiment of the present invention uses the transfer brush 20 having the above-described characteristics.

Figure 28:
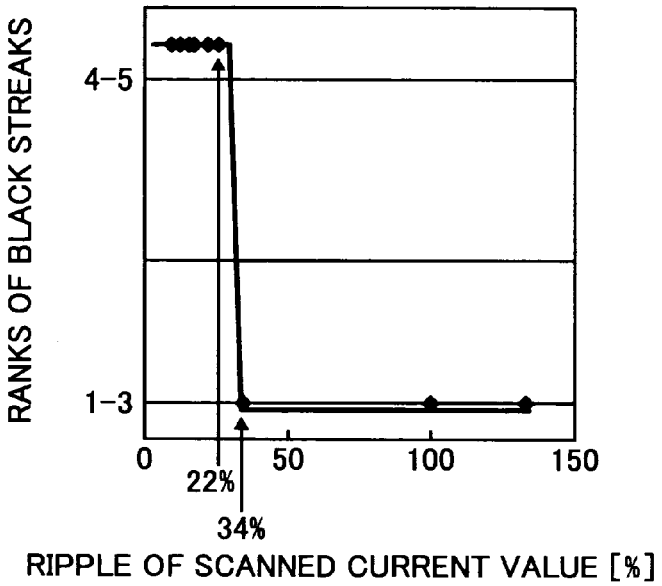
FIG. 28 is a graph showing the relationship of the ranking of the black streaks in the belt moving direction and a ripple in the sectional scanned current values.

Now, a printer according to a second exemplary embodiment of the present invention is described, referring to FIG. 28.

Since the printer according to the second exemplary embodiment of the present invention basically has the same structure as the printer 200 according to the first exemplary embodiment of the present invention, the detailed description thereof is omitted here.

FIG. 28 is a graph showing the relationship of the ranking of the black streaks in the belt moving direction and the ripple in the sectional scanned current values. The graph of FIG. 28 has plotted both results obtained when the transfer brush 20 having the raised fibers formed by a rayon material is used and when the transfer brush 20 having the raised fibers formed by a nylon material is used.

The graph of FIG. 28 shows that when the transfer brush 20 having the ripple in the sectional scanned current values less than 34% is used, the black streaks in the belt moving direction may fall in Rank 4 or Rank 5, which is the tolerance level of the transfer brush 20.

In consideration of the above-described results concurrently with the results shown in FIGS. 15, 16, 19, and 20, it is preferable that the transfer brush 20 has the brush VI value equal to or less than 38.0 μA (or the converted brush VI value equal to or smaller than 2.5 $\mu A/cm^2$) and the ripple in the sectional scanned current values less than 34%. When the transfer brush 20 having the above-described values is used, the black streaks in the belt moving direction and the sharp changes in image density can effectively be reduced or prevented, regardless of the base resin of the raised fibers (rayon or nylon). Therefore, the printer according to the second exemplary embodiment of the present invention uses the transfer brush 20 having the above-described characteristics.

Further, for safety, the ripple in the sectional scanned current values is preferably kept to be approximately 22%.

Even when the above-described conditions are met, it is difficult to reduce or prevent the black streaks in the belt moving direction and the sharp changes in image density when the rayon transfer brush 20 is used. Specifically, as previously shown in Tables 7 and 8, and FIGS. 20 and 21, when the rayon transfer brush 20 is used, the sheet conveying belt 11 has the belt VI value equal to or greater than 49 μA, preferably the belt VI value in the range from approximately 49 μA to approximately 95 μA, the black streaks in the belt moving direction and the sharp changes in image density can simultaneously be reduced or prevented. However, when the sheet conveying belt 11 having the belt VI value equal to or less than 13 μA is used, the black streaks in the belt moving direction can be reduced but the sharp changes in image density still remains.

Even through the plurality of sheet conveying belts 11 are formed by the same base resin, the entire electrical resistances of the plurality of sheet conveying belts 11 may be different when each of the plurality of sheet conveying belts 11 varies in size. For this reason, the belt VI values are converted into the corresponding values per unit area of the surface of each belt, more specifically per unit area of the transfer nip portion on the belt surface, so as to accurately describe the resistance characteristics of the entire sheet conveying belt 11.

In Experiment 2, the area of the transfer nip portion is measured to be 0.8 cm×34.2 cm. Therefore, the belt VI value per unit area of the belt surface can be obtained by dividing the belt VI value of the entire belt surface by the entire belt surface.

For example, the belt VI value of 49.0 μA is calculated as follows: 49.0 [μA]÷(0.8 [cm]×34.2 [cm])=1.8 [μA/cm$^2$]. Thus, the belt VI value per unit area of the belt surface becomes 1.8 μA/cm$^2$.

Further in Experiment 2, the belt VI value per unit area with respect to the belt VI value of 95.0 μA is obtained by assigning the value to the expression as follows: 95.0 [μA]÷(0.8 [cm]×34.2 [cm])=3.5 [μA/cm$^2$]. Thus, the belt VI value per unit of the belt surface area becomes 3.5 μA/cm$^2$.

According to the results described above, the printer for the first and second exemplary embodiments uses the rayon transfer brush 20 in combination with the sheet conveying belt 11 having the belt VI value per unit area of the belt surface, more specifically per unit area of the transfer nip portion on the belt surface, in the range from approximately 1.8 μA/cm$^2$ to approximately 3.5 μA/cm$^2$.

As previously described, the above-described experiments are conducted under the condition that the target value of the transfer current that is constantly controlled is set to 110 μA.

Next, the inventor of the present invention has also performed the above-described experiments with respect to the rayon transfer brush 20 while gradually increasing the target value of the transfer current. The results with the rayon transfer brush 20 are substantially same as the results with the target value of 110 μA until the target value reaches 130 μA.

The inventor of the present invention also performed the above-described experiments with respect to the nylon transfer brush 20 while gradually increasing the target value of the transfer current. The results with the nylon transfer brush 20 are substantially same as the results with the target value of 110 μA until the target value reaches 200 μA.

According to the above-described results, it is preferable that the target value of the transfer current is equal to or less than 130 μA while the brush VI value, the belt VI value, and the maximum scanned current value are in their respective appropriate ranges. When the transfer brush 20 having the above-described values is used, the black streaks in the belt moving direction and the sharp changes in image density can be reduced or prevented, regardless of the base resin of the raised fibers.

The relationship of a transfer current Id [μA] that flows from the sheet conveying belt 11 to the photoconductive drum 1 and a transfer charge density of the transfer current with respect to the sheet conveying belt 11 (hereinafter, referred to as an "effective transfer charge density") can be expressed by a relational expression of "Effective transfer charge density=Id/(V×L1)." "Id" in the relational expression can be same as the target value of the transfer current. "V" represents the movement speed of the sheet conveying belt 11 in units of "mm/sec." "L1" represents the length of the transfer brush 20 in the belt width direction in a unit of "mm."

Based on the above-described rational expression, the effective transfer charge density when the target value of the transfer current is set to 130 μA can be obtained as follows: 130 [μA]/(630 [mm/sec]×297.5 [mm])=6.93×10$^{-4}$ [μC/cm$^{2]=}$ 6.93×10$^{-8}$ [C/cm$^2$].

Thus, the above-described results show that it is preferable that the effective transfer charge density be equal to or less than 6.93×10$^{-8}$ C/cm$^2$ while the brush VI value, the belt VI value, and the maximum scanned current value are in their respective appropriate ranges. When the transfer device 10 having the above-described values is used, the black streaks in the belt moving direction and the sharp changes in image density can be reduced or prevented, regardless of the base resin of the raised fibers.

According to the results described above, the printer according to the first and second exemplary embodiments of the present invention use the transfer device 10 having the effective transfer charge density equal to or smaller than 6.93×10$^{-8}$ C/cm$^2$.

In general, a value of electric current output from the transfer biasing source 31 becomes greater than the transfer current value. This occurs because a portion of electric current output from the transfer biasing source 31 goes to the ground via the tension rollers instead of flowing to the photoconductive element 1. For the above-described reason, it is preferable that the transfer charge density corresponding to the output electric current from the transfer biasing source 31 be greater than the effective transfer charge density.

Next, the inventor of the present invention has prepared a plurality of sheet conveying belts 11 having different belt VI values, a plurality of transfer brushes 20 having different brush VI values, and a plurality of transfer sheets having different types. By combining the above-described elements accordingly, the inventor of the present invention has performed experiments to examine the relationship of the voltage value of the transfer bias and the value of electric current output from the transfer biasing source 31. Hereinafter, the target value of the transfer current value is referred to as a "target transfer current value," the value of electric current output from the transfer biasing source 31 is referred to as a "biasing source output current value," and the output voltage value from the transfer biasing source 31 is referred to as a "biasing source output voltage value."

Table 15 shows the results obtained using a test printer with the rayon transfer brush 20 having the brush VI value of approximately 16.1 μA under the ambient temperature of 10° C. and the relative humidity of 15% RH. The result values in Table 15 show the relationship of the paper type of the transfer sheet, the belt VI value, the target transfer current value, the biasing source output voltage value, and the biasing source output current value. The relationship shown in Table 15 is plotted on the graph of FIG. 29.

TABLE 15

| VI VALUE | PAPER TYPE | TARGET TRANSFER CURRENT VALUE (μA) | BIASING SOURCE OUTPUT VOLTAGE VALUE (kV) | BIASING SOURCE OUTPUT CURRENT VALUE (μA) |
|---|---|---|---|---|
| BELT | T6200 | 90 | 3.8 | 122 |
| 5 μA | | 110 | 4.06 | 142 |
| (0.18 μA/cm$^2$) | | 130 | 4.5 | 179 |
| BRUSH | OHP | 90 | 4.74 | 121 |
| 16.1 μA | | 110 | 5.4 | 136 |
| (1.08 μA/cm$^2$) | | 130 | 5.8 | 172 |
| | 180K | 90 | 5.72 | 122 |
| | | 110 | 5.8 | 142 |
| | | 130 | 5.9 | 170 |
| BELT | T6200 | 90 | 3.34 | 133 |
| 58 μA | | 110 | 3.6 | 153 |
| (2.11 μA/cm$^2$) | | 130 | 4 | 196 |
| BRUSH | OHP | 90 | 4.18 | 157 |
| 16.1 μA | | 110 | 4.8 | 177 |
| (1.08 μA/cm$^2$) | | 130 | 5.74 | 196 |
| | 180K | 90 | 4.18 | 145 |
| | | 110 | 5 | 157 |
| | | (150) | (5.81) | (198) |
| BELT | T6200 | 90 | 2.9 | 217 |
| 95 μA | | 110 | 3.2 | 250 |
| (3.5 μA/cm$^2$) | | 130 | 3.74 | 286 |
| BRUSH | OHP | 90 | 4.16 | 279 |
| 16.1 μA | | 110 | 4.52 | 384 |
| (1.08 μA/cm$^2$) | | 130 | 5.8 | 452 |
| | 180K | 90 | 4.3 | 334 |
| | | 110 | 4.46 | 370 |
| | | 130 | 5 | 460 |

Table 16 shows the results obtained using a test printer with the rayon transfer brush 20 having the brush VI value of approximately 38.0 μA under the ambient temperature of 32° C. and the relative humidity of 80% RH. The result values in Table 16 show the relationship of the paper type of the transfer sheet, the belt VI value, the target transfer current value, the biasing source output voltage value, and the biasing source output current value. The relationship shown in Table 16 is plotted on the graph of FIG. 30.

TABLE 16

| VI VALUE | PAPER TYPE | TARGET TRANSFER CURRENT VALUE (μA) | BIASING SOURCE OUTPUT VOLTAGE VALUE (kV) | BIASING SOURCE OUTPUT CURRENT VALUE (μA) |
|---|---|---|---|---|
| BELT 95 μA | OHP | 90 | 2.9 | 290 |
| (3.5 μA/cm$^2$) | | 110 | 3.14 | 350 |
| BRUSH 38 μA | | 130 | 4.2 | 460 |
| (2.5 μA/cm$^2$) | | | | |
| BELT | T6200 | 90 | 2.2 | 122 |
| 58 μA | | 110 | 2.4 | 143 |
| (2.11 μA/cm$^2$) | | 130 | 3 | 184 |
| BRUSH | OHP | 90 | 3.4 | 124 |
| 38 μA | | 110 | 3.66 | 144 |
| (2.5 μA/cm$^2$) | | (180) | (5.4) | (200) |
| | 180K | 90 | 2.7 | 123 |
| | | 110 | 3.04 | 143 |
| | | 130 | 3.56 | 182 |
| | 45K | 90 | 2.46 | 126 |
| | | 110 | 2.8 | 147 |
| | | 130 | 2.6 | 187 |
| BELT | T6200 | 90 | 2.04 | 126 |
| 5 μA | | 110 | 2.32 | 148 |
| (0.18 μA/cm$^2$) | | (150) | (2.84) | (188) |
| BRUSH | OHP | 90 | 3.1 | 127 |
| 38 μA | | 110 | 3.6 | 140 |

TABLE 16-continued

| VI VALUE | PAPER TYPE | TARGET TRANSFER CURRENT VALUE (μA) | BIASING SOURCE OUTPUT VOLTAGE VALUE (kV) | BIASING SOURCE OUTPUT CURRENT VALUE (μA) |
|---|---|---|---|---|
| (2.5 μA/cm$^2$) | | (180) | (4.6) | (210) |
| | 180K | 90 | 2.76 | 128 |
| | | 110 | 3.24 | 149 |
| | | (150) | (4.06) | (196) |
| | 45K | 90 | 2.5 | 129 |
| | | 110 | 2.98 | 149 |
| | | (150) | (3.18) | (188) |

Table 17 shows the results obtained using a test printer with the nylon6 transfer brush 20 having the brush VI value of approximately 20.0 μA under the ambient temperature of 10° C. and the relative humidity of 15% RH. The result values in Table 17 show the relationship of the paper type of the transfer sheet, the belt VI value, the target transfer current value, the biasing source output voltage value, and the biasing source output current value. The relationship shown in Table 17 is plotted on the graph of FIG. 31.

TABLE 17

| VI VALUE | PAPER TYPE | TARGET TRANSFER CURRENT VALUE (μA) | BIASING SOURCE OUTPUT VOLTAGE VALUE (kV) | BIASING SOURCE OUTPUT CURRENT VALUE (μA) |
|---|---|---|---|---|
| BELT | T6200 | 90 | 3.8 | 122 |
| 5 μA | | 110 | 4.06 | 142 |
| (0.18 μA/cm$^2$) | | 150 | 4.45 | 160 |
| BRUSH | | 200 | 4.6 | 165 |
| 20 μA | OHP | 90 | 4.74 | 121 |
| (1.34 μA/cm$^2$) | | 110 | 5.4 | 136 |
| | | 150 | 5.8 | 172 |
| | | 200 | 5.9 | 150 |
| | 180K | 90 | 5.3 | 122 |
| | | 110 | 5.7 | 142 |
| | | 150 | 5.9 | 170 |
| | | 200 | 5.8 | 160 |
| BELT | T6200 | 90 | 2.9 | 217 |
| 95 μA | | 110 | 3.2 | 250 |
| (3.5 μA/cm$^2$) | | 150 | 3.74 | 286 |
| BRUSH | | 200 | 4.1 | 370 |
| 20 μA | OHP | 90 | 4 | 250 |
| (1.34 μA/cm$^2$) | | 110 | 4.52 | 384 |
| | | 150 | 5.8 | 492 |
| | | 200 | 5.8 | 500 |
| | 180K | 90 | 4.5 | 340 |
| | | 110 | 4.46 | 370 |
| | | 150 | 5.7 | 440 |
| | | 200 | 5.8 | 500 |

Table 18 shows the results obtained using a test printer with the nylon transfer brush 20 having the brush VI value of approximately 64.2 μA under the ambient temperature of 32° C. and the relative humidity of 80% RH. The result values in Table 18 show the relationship of the paper type of the transfer sheet, the belt VI value, the target transfer current value, the biasing source output voltage value, and the biasing source output current value. The relationship shown in Table 18 is plotted on the graph of FIG. 32.

TABLE 18

| VI VALUE | PAPER TYPE | TARGET TRANSFER CURRENT VALUE (μA) | BIASING SOURCE OUTPUT VOLTAGE VALUE (kV) | BIASING SOURCE OUTPUT CURRENT VALUE (μA) |
|---|---|---|---|---|
| BELT 95 μA | OHP | 90 | 2.9 | 290 |
| (3.5 μA/cm$^2$) | | 110 | 3.34 | 325 |
| BRUSH | | 150 | 4.2 | 445 |
| 64.2 μA | | 180 | 4.96 | 490 |
| (4.32 μA/cm$^2$) | | | | |
| BELT | OHP | 90 | 3.1 | 127 |
| 5 μA | | 110 | 3.6 | 140 |
| (0.18 μA/cm$^2$) | | 180 | 4.6 | 170 |
| BRUSH | 180K | 90 | 2.76 | 128 |
| 64.2 μA | | 110 | 3.24 | 149 |
| (4.32 μA/cm$^2$) | | 150 | 3.8 | 196 |
| | | 180 | 3.94 | 218 |

As previously described, the rayon transfer brush 20 has a narrower tolerance level of the transfer bias than the nylon transfer brush 20. Specifically, while the allowable transfer current value of the nylon transfer brush 20 is 200 μA, the allowable transfer current value of the rayon transfer brush 20 is 130 μA. In various combinations of the brush VI value and the paper type, when the target transfer current value is set to the upper limit value of the transfer current, which is 130 μA, the maximum value of the biasing source output current values becomes 460 μA according to FIGS. 29 and 30.

Figure 29:
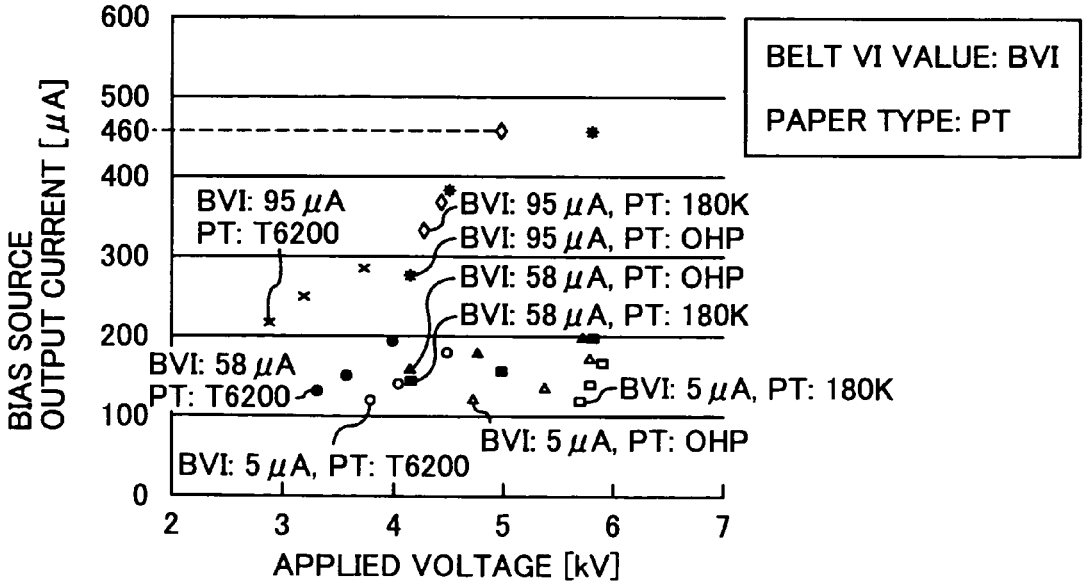
FIG. 29 is a graph showing the relationship of a paper type of the recording medium, the belt VI value, the target value of a transfer current value, the output voltage value from a transfer biasing source, and a biasing source output current value when the transfer device employs the transfer brush including a rayon material having the brush VI value of approximately 16.1 μA under the ambient temperature of 10° C. and the relative humidity of 15% RH.
Figure 30:
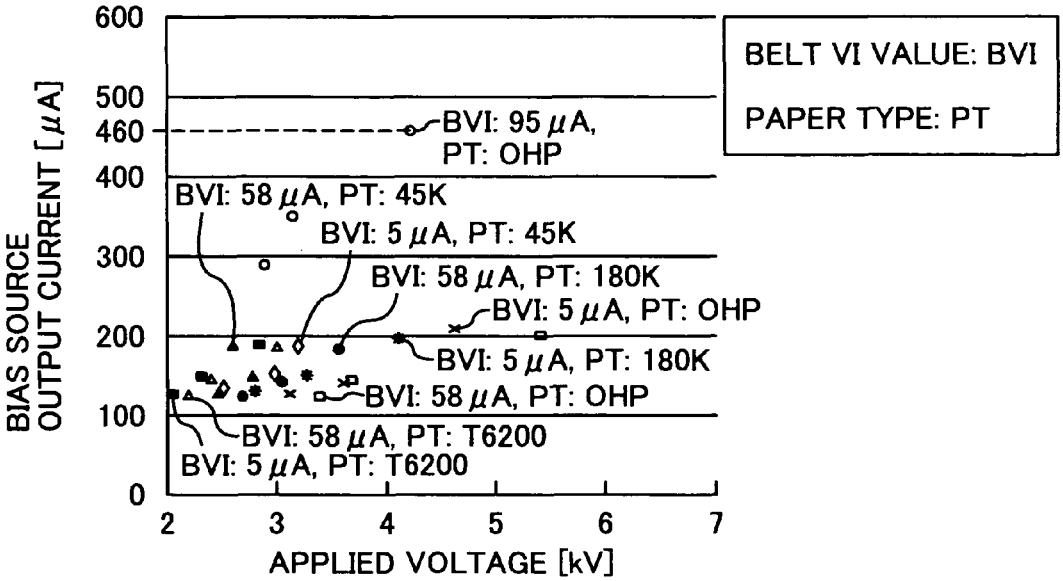
FIG. 30 is a graph showing the relationship of a paper type of the recording medium, the belt VI value, the target value of a transfer current value, the output voltage value from a transfer biasing source, and a biasing source output current value when the transfer device employs the transfer brush including a rayon material having the brush VI value of approximately 38.0 μA under the ambient temperature of 32° C. and the relative humidity of 80% RH.

FIG. 29 corresponding to Table 15 and FIG. 30 corresponding Table 16 include the results obtained by providing the target transfer current value greater than 130 μA. Still, the maximum value of the biasing source output current values remain to be 460 μA or smaller.

The transfer charge density can be obtained by converting the maximum value of the biasing source output current of 460 μA with the calculation as follows: 460 [μA]/(630 [mm/sec]×297.5 [mm])=$2.45\times10^{-7}$ [C/cm$^2$].

When the target transfer current value is set to a value smaller than 110 μA, the image forming operation has often resulted in poor transferability. Thus, the lower limit value of the transfer current is determined to be 110 μA.

To obtain the transfer current of 110 μA, the transfer biasing source 31 needs to output the amount of electric current greater than the amount of the transfer current. The transfer current of 110 μA can be converted into the transfer charge density by calculating as follows: 110 [μA]/(630 [mm/sec]×297.5 [mm])=$5.87\times10^{-8}$ [C/cm$^2$].

According to the results described above, the printer according to the first and second exemplary embodiments of the present invention uses the transfer device 10 having the transfer charge density from the transfer biasing source 31 to be greater than $5.87\times10^{-8}$ C/cm$^2$ and equal to or smaller than $2.45\times10^{-7}$ C/cm$^2$.

Now, a printer according to a third exemplary embodiment of the present invention is described.

Since the printer according to the third exemplary embodiment of the present invention basically has the same structure as the printer 200 according to the first exemplary embodiment of the present invention, the detailed description thereof is omitted here.

Referring back to FIGS. 14 through 21, respectively corresponding to Tables 1 through 8, it is clear that the transfer device 10 having the rayon transfer brush 20 tends to cause the black streaks in the belt moving direction easier than the transfer device 10 having the nylon transfer brush 20.

The nylon transfer brush 20 can raise the lower limit value of the allowable brush VI value from 38.0 μA to 64.2 μA. The nylon transfer brush 20 can also raise the lower limit value of the allowable maximum sectional scanned current value from 11.00 μA to 28.25 μA. The raising of the lower limit value can extend the allowable range of the electrical resistance values of the transfer brush 20. That is, the range of selections for the materials of the brushing fiber portion 22 can be expanded. The brush VI value of 64.2 μA can be converted into the brush VI value per unit area of the brush surface by calculating as follows: 64.2 [μA]÷(0.5. [cm]×29.75 [cm])=4.32 [μA/cm$^2$].

As previously described, as the brush VI value becomes smaller, the possibility of causing the black streaks in the belt moving direction becomes lesser. Accordingly, the hundredth place of the brush VI value per unit area is preferably rounded to be 4.3. Consequently, the brush VI value per unit area can be calculated to be 4.3 μA/cm$^2$ or smaller.

The maximum sectional scanned current value of 28.25 μA can be converted into the maximum sectional scanned current value per unit area of the brush surface by calculating as follows: 28.25 [μA]÷(0.5 [cm]×1.0 [cm])=56.50 [μA/cm$^2$].

As previously described, as the maximum sectional scanned current value becomes smaller, the possibility of causing the black streaks in the belt moving direction decreases. Accordingly, the hundredth place of the maximum sectional scanned current value per unit area is preferably rounded to be 56.5. Consequently, the maximum sectional scanned current value per unit area can be calculated to be 56.5 μA/cm$^2$ or smaller.

Referring again to FIGS. 14 through 21, respectively corresponding to Tables 1 through 8, it is clear that the rayon transfer brush 20 tends to extend the optimum range of the belt VI value more than the nylon transfer brush 20.

As described above, even though the brush VI value, maximum sectional scanned current value, and the ripple of the rayon transfer brush 20 are regulated, sharp changes may occur in image density on the halftone area of an image when the belt VI value of the sheet conveying belt 11 is equal to or smaller than 13 μA. That is, it is necessary to use the sheet conveying belt 11 having a relatively high belt VI value or a relatively low electric resistance value.

Conversely, when the brush VI value, the maximum scanned current value, and the ripple of the nylon transfer brush 20 are regulated, the black streaks in the belt moving direction and the sharp changes in image density can be reduced or prevented while the belt VI value is set in the wide range from approximately 5 μA to approximately 95 μA.

As previously described, as the belt VI value becomes smaller, the possibility of causing the sharp changes in image density increases. Accordingly, the optimum range of the belt VI value of the sheet conveying belt 11 has been proved to be at least from approximately 5 μA to approximately 95 μA.

According to the above-described results, the materials of the sheet conveying belt 11 can have the wider range of selections. That is, the above-described results has allowed more flexibility of the structure or design of the sheet conveying belt 11.

According to the results described above, the printer according to the third exemplary embodiment of the present invention uses the nylon transfer brush 20 having the raised fibers formed by a nylon material or a polyamide resin material, the converted brush VI value equal to or smaller than 4.3 μA/cm$^2$, and the converted maximum scanned current value equal to or smaller than 56.5 μA/cm$^2$.

For example, the belt VI value of 5 μA is calculated as follows: 5 [μA]÷(0.8 [cm]×34.2 [cm])=0.18 [μA/cm$^2$]. Thus, the belt VI value per unit area of the belt surface becomes 0.18 μA/cm$^2$.

Further, the belt VI value per unit area with respect to the belt VI value of 95.0 μA is obtained as follows: 95.0 [μA]÷(0.8 [cm]×34.2 [cm])=3.5 [μ/cm$^2$]. Therefore, the belt VI value per unit of the belt surface area becomes 3.5 μA/cm$^2$.

According to the results described above, the printer according to the third exemplary embodiment of the present invention uses the nylon transfer brush 20 in combination with the sheet conveying belt 11 having the belt VI value per unit area of the belt surface. More specifically, the per unit area of the transfer nip portion on the belt surface is in the range of approximately 0.18 μA/cm$^2$ to approximately 3.5 μA/cm$^2$.

Figure 33:
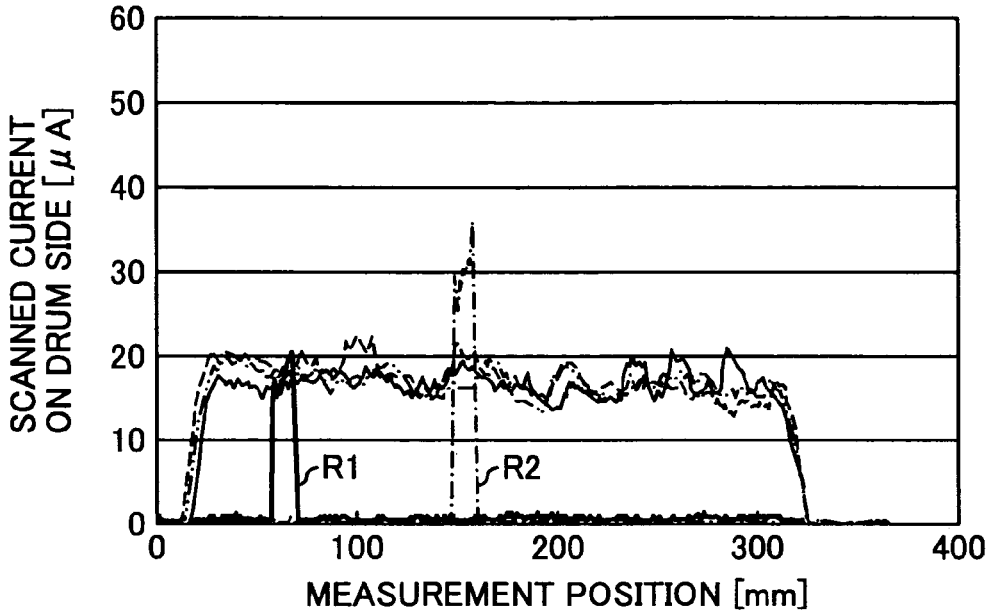
FIG. 33 is a graph showing the relationship of the sectional scanned current values on the image bearing member side and a position of measurement.
Figure 34:
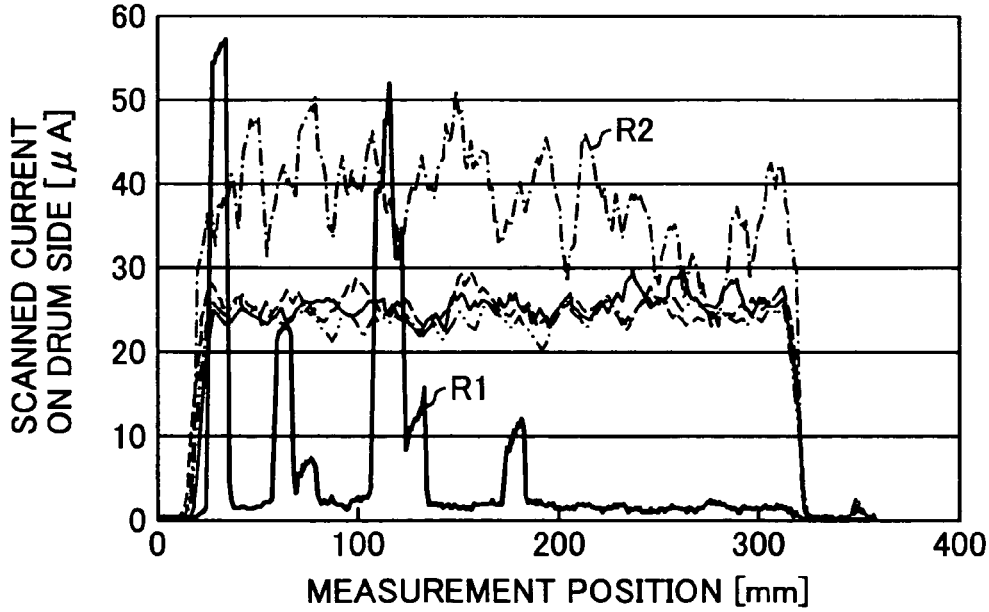
FIG. 34 is a graph showing the relationship of the sectional scanned current values and a position of measurement.

Now, referring to FIGS. 33 and 34, the reason for the rayon transfer brush 20 easily causing black streaks in the belt moving direction more frequently than the nylon transfer brush 20 is discussed.

FIG. 33 is a graph showing the relationship of the drum-side scanned current values and the position of measurement, which is the position in the longitudinal direction of the transfer brush 20, in the above-described Experiment 2. FIG. 34 is a graph showing the relationship of the sectional scanned current values and the position of measurement in the above-described Experiment 2. In FIGS. 33 and 34, the two curved lines with the reference signs "R1" and "R2" indicate the measurement results on the rayon transfer brush 20. The other three curved lines with no reference signs indicate the measurement results on the nylon transfer brush 20.

From the graphs of FIGS. 33 and 34, it is clear that the rayon transfer brush 20 has more variations in the electric resistance values in the longitudinal direction thereof than the nylon transfer brush 20. Such variations in the electric resistance values can attract the transfer current to intensively flow to the portion of the transfer brush 20 on which the electric resistance value becomes greater in the longitudinal direction of the transfer brush 20. With the above-described condition, the rayon transfer brush 20 can cause the black streaks in the belt moving direction more frequently.

As previously described, each of the raised fibers used for the brushing fiber portion 22 of the transfer brush 20 includes carbon powder dispersed in the base resin thereof. Since the fabrication of fiber dedicated to the transfer brush 20 is extremely expensive, it is desirable to use a general type of fiber available on the market. While the nylon fibers having various electric resistance values are on the market, the rayon fibers available on the market have values lower than the optimum value for the transfer brush 20 and it is difficult to obtain the rayon fibers having electric resistance values appropriate for the transfer brush 20.

Due to the above-described reason, a special treatment is applied to the rayon fibers so as to raise the electric resistance values thereof. The special treatment, however, cannot uniformly raise the electric resistance values of the rayon fibers in the standing direction thereof. Specifically, at least one portion of the rayon fibers of the transfer brush 20 has the electric resistance values smaller than the other portion in the standing direction thereof. The raised fibers on the above-described portion of the transfer brush 20 may have an extremely smaller electric resistance value than the other raised fibers on the other portion, and may cause the transfer current to intensively flow at the at least one portion. Therefore, the rayon transfer brush 20 tends to cause the black streaks in the belt moving direction.

Now, a printer according to a fourth exemplary embodiment of the present invention is described.

Since the printer according to the fourth exemplary embodiment of the present invention basically has the same structure as the printer 200 according to the first exemplary embodiment of the present invention, the detailed description thereof is omitted here.

As previously described in reference to FIGS. 14 through 17, respectively corresponding to Tables 1 through 4, the nylon transfer brush 20 can reduce or prevent the possibility of sharp changes in image density by having the brush VI value equal to or smaller than 64.2 μA or the brush VI value per unit area equal to or smaller than 4.3 μA/cm$^2$.

Further, as previously described in reference to FIG. 28, when the transfer brush 20 having the ripple in the sectional scanned current values less than 34% is used, the black streaks in the belt moving direction may fall in Rank 4 or Rank 5, which is the tolerance level of the transfer brush 20.

According to the results described above, the printer for the fourth exemplary embodiment uses the nylon transfer brush 20 having the above-described characteristics.

In addition, the printer according to the fourth exemplary embodiment of the present invention uses the nylon transfer brush 20 in combination with the sheet conveying belt 11 having the belt VI value per unit area of the belt surface. More specifically, the per unit area of the transfer nip portion on the belt surface is in the range of approximately 0.18 μA/cm$^2$ to approximately 3.5 μA/cm$^2$, which is based on the same reasons as the printer according to the third exemplary embodiment of the present invention.

Table 19 shows the relationship of the brush VI value and the fiber resistance value per unit length of the raised fibers of the nylon transfer brush 20. The relationship shown in Table 19 is plotted on the graph of FIG. 35.

TABLE 19

| BRUSH VI VALUE [μA] | FIBER RESISTANCE VALUE [Ω/mm] |
|---|---|
| 25.9 | $5.7 \times 10^{11}$ |
| 33.4 | $5.7 \times 10^{11}$ |
| 64.2 | $3.0 \times 10^{10}$ |
| 65.4 | $3.0 \times 10^{10}$ |
| 66.6 | $3.0 \times 10^{10}$ |
| 67.6 | $3.0 \times 10^{10}$ |
| 66.6 | $3.0 \times 10^{10}$ |
| 65.9 | $3.0 \times 10^{10}$ |
| 64.0 | $3.0 \times 10^{10}$ |
| 67.6 | $3.0 \times 10^{10}$ |
| 65.8 | $3.0 \times 10^{10}$ |
| 8.5 | $3.0 \times 10^{11}$ |
| 17.9 | $3.0 \times 10^{11}$ |
| 20.0 | $5.7 \times 10^{11}$ |
| 35.5 | $5.7 \times 10^{11}$ |
| 96.5 | $2.3 \times 10^{6}$ |

Figure 35:
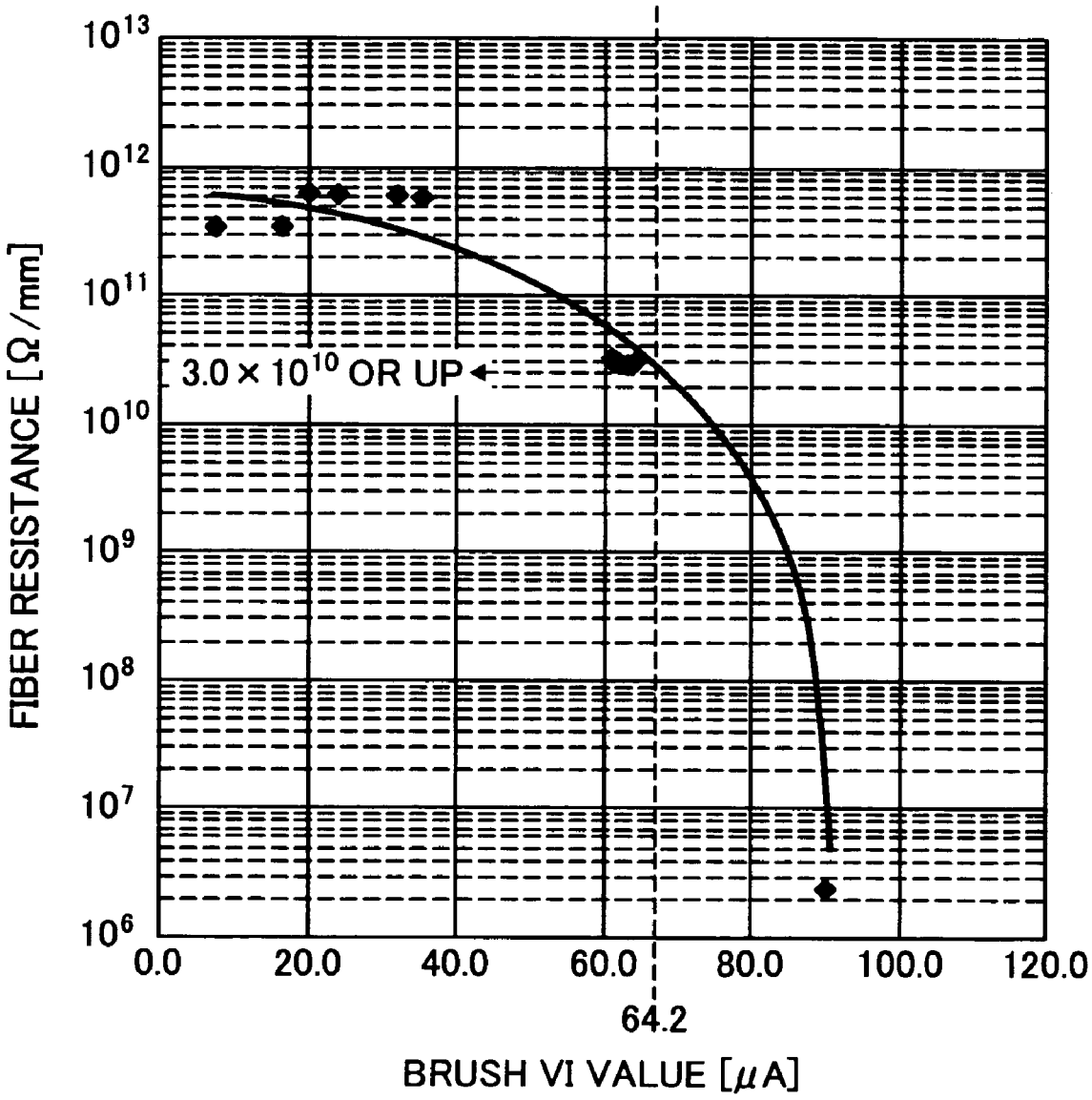
FIG. 35 is a graph showing the relationship of the brush VI value of the nylon transfer brush and a fiber resistance value per unit length of a single fiber of thereof.

According to the graph of FIG. 35, the transfer brush 20 formed by the raised fibers having the brush VI value equal to or smaller than 64.2 μA can reduce or prevent sharp changes in image density, as previously described. Such raised fibers may have the fiber resistance value per unit length of the raised fiber of $3.3 \times 10^{10}$ Ω/mm.

According to the results described above, the printer according to the third and fourth exemplary embodiments uses the transfer brush 20 having the above-described characteristics.

As previously described in reference to FIGS. 23 through 27, which respectively correspond to Tables 10 through 14, when the transfer brush 20 has the maximum drum-side scanned current value smaller than the maximum sectional scanned current value, the ranking of the black streaks in the belt moving direction can be raised.

Due to the results described above, the printer according to the first through fourth exemplary embodiments uses the transfer brush 20 having the above-described characteristics.

Table 20 shows the attributes of materials including nylon6 or rayon.

TABLE 20

| | | MATERIAL | | | | |
|---|---|---|---|---|---|---|
| | | NYLON6 | | | RAYON | |
| | | CONDUCTIVE ELEMENT | | | | |
| | | CARBON | | | CARBON | |
| | | STRUCTURE | | | | |
| | | DISPERSION TYPE | | | DISPERSION TYPE | |
| LINEAR DENSITY OF FIBER MASS | DT/F | 330/48 | 220/96 | 220/192 | 330/100 | 660/100 |
| LINEAR DENSITY OF SINGLE FIBER | DT | 6.9 | 2.3 | 1.1 | 3.3 | 6.6 |
| DIAMETER OF SINGLE FIBER | ϕμm | ϕ27 | ϕ15 | ϕ11 | ϕ16 | ϕ23 |
| SPECIFIC GRAVITY | | 1.26 | | | 1.57 | |
| MELTING POINT | | 220° C. | | | — | |
| SOFTENING POINT | | 190° C. | | | — | |
| TENSILE STRENGTH | cN/dt | 1.1-1.3 | | | 0.8-0.9 | |
| YOUNG'S MODULUS | cN/mm2 | 900-1000 | | | 3200 | |
| MOISTURE CONTENT IN PERCENTAGE | 20° C.50% RH | 4.50% | | | 12.3%-25% | |
| | 20° C.65% RH | 3.5-5.0% | | | — | |
| | 20° C.95% RH | 8.0-9.0% | | | — | |

As shown in Table 20, the moisture content of the raised fiber of the nylon transfer brush 20 is equal to or less than 9.0% under an ambient temperature of 20° C. and a relative humidity of 95% RH. On the contrary, the moisture content of the rayon transfer brush 20 is in the range from approximately 12.3% to approximately 25% under the ambient temperature of 20° C. and the relative humidity of 95% RH. Accordingly, it is clear that the nylon material has the lower percentage of moisture content than the rayon material.

Referring to FIG. 36, the attributes of nylon materials, nylon6 and nylon12, are described.

Nylon6 has carbon powders dispersed uniformly in the cross-sectional direction of each carbon powder. Nylon12 has carbon powders dispersed around the outer edge in the cross-sectional direction of each carbon powder.

As previously described for the printer according to the first and second exemplary embodiments of the present invention, the nylon transfer brush 20 has the tolerance level of transfer current in the range from approximately 110 μA to approximately 200 μA.

The effective transfer charge density when the upper limit value of the transfer current is 200 μA can be obtained as follows: 200 [μA]/(630 [mm/sec]×297.5 [mm])=$1.06\times10^{-7}$ [C/cm$^2$].

Thus, the results of Experiments 1 and 2 show the preferable condition of the printer according to the third and fourth exemplary embodiments of the present invention. Specifically, when the brush VI value of the transfer brush 20, the belt VI value of the sheet conveying belt 11, and the maximum sectional scanned current value are in the appropriate range, it is preferable to use the printer having the effective transfer charge density equal to or less than $1.06\times10^{-7}$ C/cm$^2$. With the above-described conditions, the black streaks in the belt moving direction and the sharp changes in image density can effectively be reduced or prevented.

In accordance with the results described above, the printer according to the third and fourth exemplary embodiments uses the transfer device 10 having the effective transfer charge density equal to or less than $1.06\times10^{-7}$ C/cm$^2$.

Figure 31:
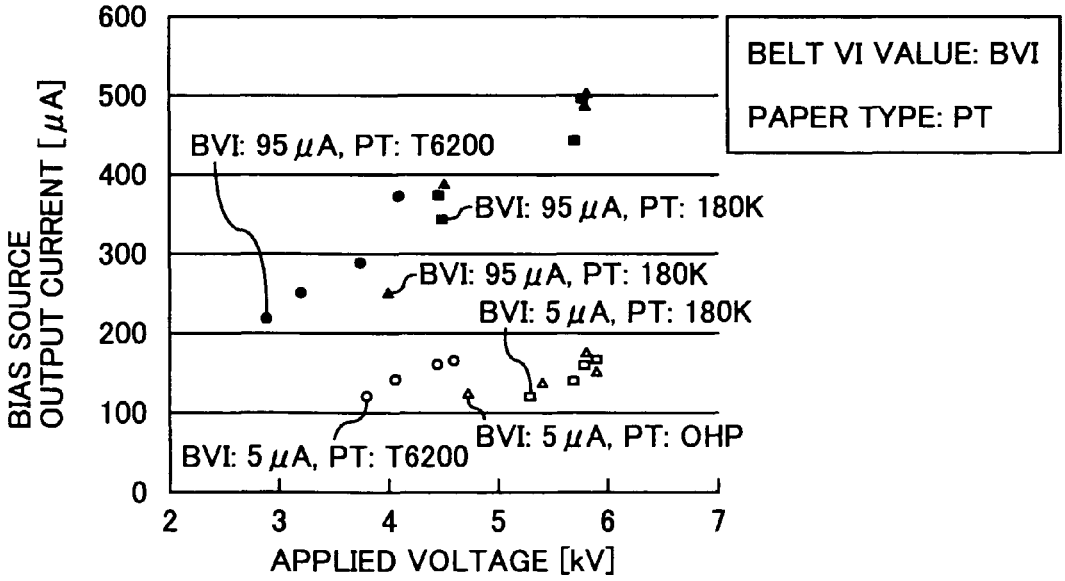
FIG. 31 is a graph showing the relationship of a paper type of the recording medium, the belt VI value, the target value of a transfer current value, the output voltage value from a transfer biasing source, and a biasing source output current value when the transfer device employs the transfer brush including a nylon material having the brush VI value of approximately 20.0 μA under the ambient temperature of 10° C. and the relative humidity of 15% RH.
Figure 32:
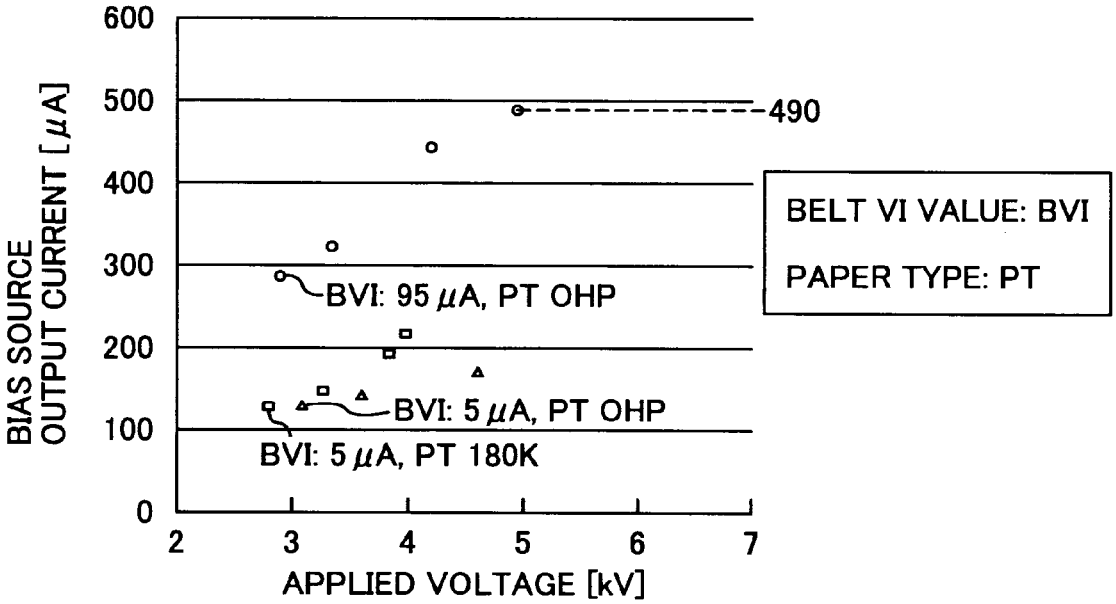
FIG. 32 is a graph showing the relationship of a paper type of the recording medium, the belt VI value, the target value of a transfer current value, the output voltage value from a transfer biasing source, and a biasing source output current value when the transfer device employs the transfer brush including a nylon material having the brush VI value of approximately 34.2 μA under the ambient temperature of 32° C. and the relative humidity of 80% RH.

As previously described in reference to FIG. 31 corresponding to Table 17 and FIG. 32 corresponding to Table 18, the maximum value of the biasing source output current becomes 500 μA when the nylon transfer brush 20 is employed and the value of transfer current is set to the upper limit value, 200 μA.

The maximum value of the biasing source output current values can be converted into the transfer charge density by calculating as follows: 500 [μA]/(630 [mm/sec]×297.5 [mm])=$2.67\times10^{-7}$ [C/cm$^2$].

To obtain the transfer current of 110 μA, which is the lower limit value thereof, the transfer biasing source 31 needs to output the amount of electric current greater than the amount of the above-described transfer current.

According to the results described above, the printer using the nylon transfer brush 20 according to the third and fourth exemplary embodiments uses the transfer device 10 having the transfer charge density greater than $5.87\times10^{-8}$ C/cm$^2$ and equal to or less than $2.67\times10^{-7}$ C/cm$^2$.

The printers including the printers 200 and 300 according to the first through fourth exemplary embodiments of the present invention employ the transfer mechanism in which the sheet conveying belt 11 serving as a belt member carries the transfer sheet S on the outer surface thereof for receiving a toner image formed on the surface of the photoconductive drum 1. However, as an alternative, the present invention can be applied to a printer employing the transfer mechanism in which an intermediate transfer belt serving as a belt member directly receives a toner image formed on the surface of a photoconductive element so as to transfer the toner image onto a transfer sheet.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Obviously, numerous modifications and variations of the present invention are possible in light of the above teachings. It is therefore to be understood that within the scope of the appended claims, the invention may be practiced otherwise than as specifically described herein.

The invention claimed is:

1. An image forming apparatus, comprising:

an image bearing member configured to bear an image on a surface thereof; and a transfer device configured to transfer the image from the surface of the image bearing member, to a recording medium, the transfer device including an endless moving member which conveys the recording medium, the endless moving member held in contact with the image bearing member, and a brush member configured to apply a transfer bias with respect to the endless moving member, the brush member including a fiber portion including a plurality of fibers arranged in a standing condition, the plurality of fibers including respective fiber tips which collectively form a whole brush surface, the fiber tips held in contact with an inner surface of the endless moving member, and a supporting member configured to support the fiber portion on a surface thereof, wherein the brush member is configured to have a whole brush current value per unit area of the whole brush surface equal to or smaller than 2.5 $\mu A/cm^2$ and a maximum sectional scanned current value per unit area of a portion of the whole brush surface equal to or smaller than 22.0 $\mu A/cm^2$, the sectional scanned current values being values of sectional transfer current obtained by sequentially scanning the whole brush surface at a predetermined interval, and the maximum sectional scanned current value determined from the sectional scanned current values.

2. The image forming apparatus according to claim 1, wherein the brush member is configured to have a maximum sectional scanned current value per unit area of a portion of the whole brush surface closer to an image bearing member smaller than the maximum sectional scanned current value per unit area of a portion of the whole brush surface.

3. An image forming apparatus, comprising:

an image bearing member configured to bear an image on a surface thereof; and a transfer device configured to transfer the image from the surface of the image bearing member, to a recording medium, the transfer device including an endless moving member which conveys the recording medium, the endless moving member held in contact with the image bearing member, and a brush member configured to apply a transfer bias with respect to the endless moving member, the brush member including a fiber portion including a plurality of fibers arranged in a standing condition, the plurality of fibers including respective fiber tips which collectively form a whole brush surface and a polyamide resin material with a conductive electrical resistance controller therein, the fiber tips held in contact with an inner surface of the endless moving member, and a supporting member configured to support the fiber portion on a surface thereof, wherein the brush member is configured to have a whole brush current value per unit area of the whole brush surface equal to or smaller than 4.3 $\mu A/cm^2$ and a maximum sectional scanned current value per unit area of a portion of the whole brush surface equal to or smaller than 56.5 $\mu A/cm^2$, the sectional scanned current values being values of sectional transfer current obtained by sequentially scanning the whole brush surface at a predetermined interval, and the maximum sectional scanned current value determined from the sectional scanned current values.

4. The image forming apparatus according to claim 3, wherein the brush member is configured to have a maximum sectional scanned current value per unit area of a portion of the whole brush surface closer to an image bearing member smaller than the maximum sectional scanned current value per unit area of a portion of the whole brush surface.

5. An image forming apparatus, comprising:

an image bearing member configured to bear an image on a surface thereof; and a transfer device configured to transfer the image from the surface of the image bearing member, to a recording medium, the transfer device including an endless moving member which conveys the recording medium, the endless moving member held in contact with the image bearing member, and a brush member configured to apply a transfer bias with respect to the endless moving member, the brush member including a fiber portion including a plurality of fibers arranged in a standing condition, the plurality of fibers including respective fiber tips which collectively form a whole brush surface and a polyamide resin material with a conductive electrical resistance controller therein, the fiber tips held in contact with an inner surface of the endless moving member, and a supporting member configured to support the fiber portion on a surface thereof, wherein the brush member is configured to have a whole brush current value per unit area of the whole brush surface equal to or smaller than 4.3 $\mu A/cm^2$ and an electrical resistance per unit length of a single fiber of the plurality of fibers equal to or greater than $3.3\times10^{10}$ $\Omega$/mm.

6. The image forming apparatus according to claim 5, wherein the brush member is configured to have a maximum sectional scanned current value per unit area of a portion of the whole brush surface closer to an image bearing member smaller than the maximum sectional scanned current value per unit area of a portion of the whole brush surface.

7. An image forming apparatus, comprising:

an image bearing member configured to bear an image on a surface thereof; and a transfer device configured to transfer the image from the surface of the image bearing member, to a recording medium, the transfer device including an endless moving member which conveys the recording medium, the endless moving member held in contact with the image bearing member and including a conveying belt configured to have a belt current value per unit area of a transfer nip formed between the conveying belt and the image bearing member, the belt current value being in a range of approximately 1.8 $\mu A/cm^2$ to approximately 3.5 $\mu A/cm^2$, and a brush member configured to apply a transfer bias with respect to the endless moving member, the brush member including a fiber portion including a plurality of fibers arranged in a standing condition, the plurality of fibers including respective fiber tips which collectively form a whole brush surface, the fiber tips held in contact with an inner surface of the endless moving member, and a supporting member configured to support the fiber portion on a surface thereof, wherein the brush member is configured to have a whole brush current value per unit area of the whole brush surface equal to or smaller than 2.5 $\mu A/cm^2$.

8. The image forming apparatus according to claim 7, wherein the transfer device is configured to have an effective transfer charge density equal to or smaller than $6.93\times10^{-8}$ $C/cm^2$.

9. The image forming apparatus according to claim 7, wherein the transfer device is configured to have a transfer charge density of an output current from a transfer biasing source, the transfer charge density being greater than the effective transfer charge density and equal to or smaller than $2.45\times10^{-7}$ $C/cm^2$.

10. The image forming apparatus according to claim 7, wherein the transfer device is configured to have a transfer charge density of an output current from a transfer biasing source, the transfer charge density being greater than $5.87\times10^{-8}$ $C/cm^2$ and equal to or smaller than $2.45\times10^{-7}$ $C/cm^2$.

11. An image forming apparatus, comprising:

an image bearing member configured to bear an image on a surface thereof; and a transfer device configured to transfer the image from the surface of the image bearing member, to a recording medium, the transfer device including an endless moving member which conveys the recording medium, the endless moving member held in contact with the image bearing member and including a conveying belt configured to have a belt current value per unit area of a transfer nip formed between the conveying belt and the image bearing member, the belt current value per unit area being in a range of approximately 0.18 $\mu A/cm^2$ to approximately 3.5 $\mu A/cm^2$, and a brush member configured to apply a transfer bias with respect to the endless moving member, the brush member including a fiber portion including a plurality of fibers arranged in a standing condition, the plurality of fibers including respective fiber tips which collectively form a whole brush surface and a polyamide resin material with a conductive electrical resistance controller therein, the fiber tips held in contact with an inner surface of the endless moving member, and a supporting member configured to support the fiber portion on a surface thereof, wherein the brush member is configured to have a whole brush current value per unit area of the whole brush surface equal to or smaller than 4.3 $\mu A/cm^2$.

12. The image forming apparatus according to claim 11, wherein the transfer device is configured to have an effective transfer charge density equal to or smaller than $1.06\times10^{-7}$ $C/cm^2$.

13. The image forming apparatus according to claim 11, wherein the transfer device is configured to have a transfer charge density of an output current from a transfer biasing source, the transfer charge density being greater than the effective transfer charge density and equal to or smaller than $2.67\times10^{-7}$ $C/cm^2$.

14. The image forming apparatus according to claim 11, wherein the transfer device is configured to have a transfer charge density of an output current from a transfer biasing source, the transfer charge density being greater than $5.87\times10^{-8}$ $C/cm^2$ and equal to or smaller than $2.67\times10^{-7}$ $C/cm^2$.

15. A brush member, comprising:

a fiber portion including a plurality of fibers arranged in a standing condition, the plurality of fibers having respective fiber tips which collectively form a whole brush surface, the fiber tips held in contact with an inner surface of the endless moving member; and a supporting member configured to support the fiber portion on a surface thereof, wherein the brush member is configured to have a whole brush current value per unit area of the whole brush surface equal to or smaller than 2.5 $\mu A/cm^2$ and a ripple in sectional scanned current values less than 34%, the sectional scanned current values being values of sectional transfer current obtained by sequentially scanning the whole brush surface at a predetermined interval, the maximum sectional scanned current value determined from the sectional scanned current values, and the ripple in the sectional scanned current values obtained by the expression (the maximum sectional scanned current value−the mean scanned current value)/the mean scanned current value×100%, where the mean scanned current value is the mean value of the sectional scanned current values.

16. The brush member according to claim 15, wherein the brush member is configured to have a maximum sectional scanned current value per unit area of a portion of the whole brush surface equal to or smaller than 22.0 $\mu A/cm^2$.

17. The brush member according to claim 15, wherein the plurality of fibers include a polyamide resin material with a conductive electrical resistance controller therein.

18. The brush member according to claim 15, wherein the brush member is configured to apply a maximum sectional scanned current value per unit area of a portion of the whole brush surface equal to or smaller than 56.5 $\mu A/cm^2$.

19. An image forming apparatus, comprising:

an image bearing member configured to bear an image on a surface thereof; and a transfer device configured to transfer the image from the surface of the image bearing member, to a recording medium, the transfer device including an endless moving member which conveys the recording medium, the endless moving member held in contact with the image bearing member, and a brush member configured to apply a transfer bias with respect to the endless moving member, the brush member including a fiber portion including a plurality of fibers arranged in a standing condition, the plurality of fibers including respective fiber tips which collectively form a whole brush surface, the fiber tips held in contact with an inner surface of the endless moving member, and a supporting member configured to support the fiber portion on a surface thereof, wherein the brush member is configured to have a whole brush current value per unit area of the whole brush surface equal to or smaller than 2.5 $\mu A/cm^2$ and a ripple in sectional scanned current values less than 34%, the sectional scanned current values being values of sectional transfer current obtained by sequentially scanning the whole brush surface at a predetermined interval, and the ripple in the sectional scanned current values obtained by the expression (the maximum sectional scanned current value−the mean scanned current value)/the mean scanned current value×100%, where the mean scanned current value is the mean value of the sectional scanned current values.

20. The image forming apparatus according to claim 19, wherein the brush member is configured to have a maximum sectional scanned current value per unit area of a portion of the whole brush surface closer to an image bearing member smaller than the maximum sectional scanned current value per unit area of a portion of the whole brush surface.

21. An image forming apparatus, comprising:

an image bearing member configured to bear an image on a surface thereof; and a transfer device configured to transfer the image from the surface of the image bearing member, to a recording medium, the transfer device including an endless moving member which conveys the recording medium, the endless moving member held in contact with the image bearing member, and a brush member configured to apply a transfer bias with respect to the endless moving member, the brush member including a fiber portion including a plurality of fibers arranged in a standing condition, the plurality of fibers including respective fiber tips which collectively form a whole brush surface and a polyamide resin material with a conductive electrical resistance controller therein, the fiber tips held in contact with an inner surface of the endless moving member, and a supporting member configured to support the fiber portion on a surface thereof, wherein the brush member is configured to have a whole brush current value per unit area of the whole brush surface equal to or smaller than 4.3 $\mu A/cm^2$ and a ripple in sectional scanned current values less than 34%, the sectional scanned current values being values of sectional transfer current obtained by sequentially scanning the whole brush surface at a predetermined interval, and the ripple in the sectional scanned current values obtained by the expression (the maximum sectional scanned current value−the mean scanned current value)/the mean scanned current value×100%, where the mean scanned current value is the mean value of the sectional scanned current values.

22. The image forming apparatus according to claim 21, wherein the brush member is configured to have a maximum sectional scanned current value per unit area of a portion of the whole brush surface closer to an image bearing member smaller than the maximum sectional scanned current value per unit area of a portion of the whole brush surface.

23. A brush member, comprising:

a fiber portion including a plurality of fibers arranged in a standing condition, the plurality of fibers including respective fiber tips which collectively form a whole brush surface, the fiber tips held in contact with an inner surface of the endless moving member; and a supporting member configured to support the fiber portion on a surface thereof, wherein the brush member is configured to have a whole brush current value per unit area of the whole brush surface equal to or smaller than 4.3 $\mu A/cm^2$ and a ripple in sectional scanned current values less than 34%, the sectional scanned current values being values of sectional transfer current obtained by sequentially scanning the whole brush surface at a predetermined interval, the maximum sectional scanned current value determined from the sectional scanned current values, and the ripple in the sectional scanned current values obtained by the expression (the maximum sectional scanned current value−the mean scanned current value)/the mean scanned current value×100%, where the mean scanned current value is the mean value of the sectional scanned current values.

* * * * *